US011573502B2

(12) United States Patent
Sato

(10) Patent No.: US 11,573,502 B2
(45) Date of Patent: Feb. 7, 2023

(54) IMAGE FORMING APPARATUS

(71) Applicant: CANON KABUSHIKI KAISHA, Tokyo (JP)

(72) Inventor: Kazumi Sato, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/374,612

(22) Filed: Jul. 13, 2021

(65) Prior Publication Data

US 2022/0019153 A1 Jan. 20, 2022

(30) Foreign Application Priority Data

Jul. 14, 2020 (JP) ..... JP2020-120310

(51) Int. Cl.
*G03G 15/043* (2006.01)
*G03G 15/00* (2006.01)

(52) U.S. Cl.
CPC ..... *G03G 15/043* (2013.01); *G03G 15/6529* (2013.01)

(58) Field of Classification Search
CPC ..... G03G 15/043; G03G 15/04054
See application file for complete search history.

(56) References Cited

U.S. PATENT DOCUMENTS

| | | | | |
|---|---|---|---|---|
| 7,256,814 | B2 | 8/2007 | Tsujino et al. | |
| 2006/0146117 | A1* | 7/2006 | Kobayashi | G03G 15/04072 347/224 |
| 2011/0181679 | A1* | 7/2011 | Arai | G03G 15/043 347/224 |
| 2016/0238964 | A1* | 8/2016 | Endo | G03G 15/043 |
| 2016/0282751 | A1* | 9/2016 | Yano | G03G 15/04054 |
| 2016/0349660 | A1* | 12/2016 | Hirano | G03G 15/043 |
| 2017/0261905 | A1* | 9/2017 | Itabashi | B65H 7/08 |

FOREIGN PATENT DOCUMENTS

| | | | |
|---|---|---|---|
| JP | 10-207149 | A | 8/1998 |
| JP | 2005-062325 | A | 3/2005 |
| JP | 2006-130713 | A | 5/2006 |
| JP | 2015-112856 | A | 6/2015 |

* cited by examiner

*Primary Examiner* — Carla J Therrien
(74) *Attorney, Agent, or Firm* — Venable LLP

(57) ABSTRACT

An image forming apparatus is operable in a first mode in which a photosensitive drum is rotated at a first rotational speed and a second mode in which the photosensitive drum is rotated at a second rotational speed slower than the first rotational speed. In this image forming apparatus, the light-emitting portions are controlled such that the number of light-emitting rows for multiply exposing regions, each of which corresponds to one pixel on the photosensitive drum in the first mode, is greater than that in the second mode.

8 Claims, 21 Drawing Sheets

G
Ha
Hb
Hc
Hd
He
50a
50b
50c
50d
50e
40
Y

IMAGE FORMING APPARATUS

BACKGROUND OF THE INVENTION

Field of the Invention

The present invention relates to an image forming apparatus including an exposure head.

Description of the Related Art

When an image is formed by an electrophotographic image forming apparatus, an electrostatic latent image is first formed on the surface of the photosensitive drum by irradiating the surface of the photoconductor with light corresponding to the image data. After that, a toner image is formed by adhering toner to the electrostatic latent image on the surface of the photosensitive drum with the developing device, the toner image is transferred to a sheet, and the toner image transferred to the sheet is fixed on the sheet by heating it with the fixing device to form an image.

When thick paper is used as a sheet on which the image is formed, the heat quantity required to fix the toner image on the sheet is larger because the sheet has a higher heat capacity than a sheet with a relatively small basis weight such as plain paper. A configuration is known in which the sheet conveying speed becomes lower than usual, and the fixing device heats the toner image borne on the sheet for a longer period of time, thereby applying more heat to the toner image to stably fix the toner image even on thick paper. Namely, an image forming apparatus with this configuration has a normal-speed mode in which a sheet is conveyed at a normal speed, and a low-speed mode in which the sheet is conveyed at a speed lower than the normal-speed mode. The rotational speed of the photosensitive drum is related to the sheet conveying speed so that the rotational speed of the photosensitive drum will be lower when the low-speed mode is performed than when the normal-speed mode is performed.

Japanese Patent Application Laid-Open No. 2015-112856 describes an image forming device that irradiates a photosensitive drum with light to form an electrostatic latent image. This image forming apparatus includes an exposure head having light emitting portions using LEDs or Organic Electro-Luminescence and lenses that image the light emitted from the light emitting portions onto the surface of the photosensitive drum. By using such an exposure head, the number of parts can be reduced compared to the configuration of the laser scanning system, in which a laser beam is deflected and scanned by a rotating polygon mirror to form an electrostatic latent image, so that the size of the image forming apparatus is reduced and the manufacturing cost is decreased.

By the way, the amount of light of one of the light-emitting portions using LED or Organic Electro-Luminescence that has the exposure head is not large enough. Therefore, to compensate for the amount of light needed to form an electrostatic latent image on the surface of the photosensitive drum, the configuration is considered in which the photosensitive drum is multiply exposed by a plurality of light emitting portions.

SUMMARY OF THE INVENTION

A representative configuration of the present invention is an image forming apparatus including a rotating photosensitive drum, the image forming apparatus being capable of performing a first mode in which the photosensitive drum is rotated at a first rotating speed and a second mode in which the photosensitive drum is rotated at a second rotating speed lower than the first rotating speed, the image forming apparatus comprising:

an exposure head including light-emitting rows each of which includes light-emitting portions configured to emit light for exposing the photosensitive drum, the light-emitting portions being arranged along a rotational axis direction of the photosensitive drum, the light-emitting rows being arranged in a direction crossing the rotational axis direction, the exposure head being configured to multiply expose regions, each of which corresponds to one pixel, on the photosensitive drum with light-emitting portions included in a plurality of rows out of the light-emitting rows; and a control unit configured to control the light-emitting portions such that each region of the regions is multiply exposed by light-emitting portions included in a plurality of rows out of the light-emitting rows, and such that the number of a plurality of rows of light-emitting portions that emit light for multiply exposing each region in the first mode is greater than that in the second mode.

Further features of the present invention will become apparent from the following description of exemplary embodiments with reference to the attached drawings.

DESCRIPTION OF THE EMBODIMENTS

<Image Forming Apparatus>

Hereinafter, the overall configuration of the image forming apparatus A according to the present invention will be described together with image forming operations with reference to the drawings. The dimensions, materials, shapes, and relative arrangements of the components described below are not intended to limit the scope of the present invention only to them unless otherwise specified.

The image forming apparatus A is a full-color image forming apparatus that forms an image by transferring four color toners (yellow Y, magenta M, cyan C, and black K) onto a sheet. In the following description, the subscripts Y, M, C, and K are generally added to the members that use the toners of respective colors. However, these subscripts are omitted as appropriate unless distinction is required since the configuration and operations of those members are substantially the same as each other except for the difference in color of the toner used.

Figure 1:
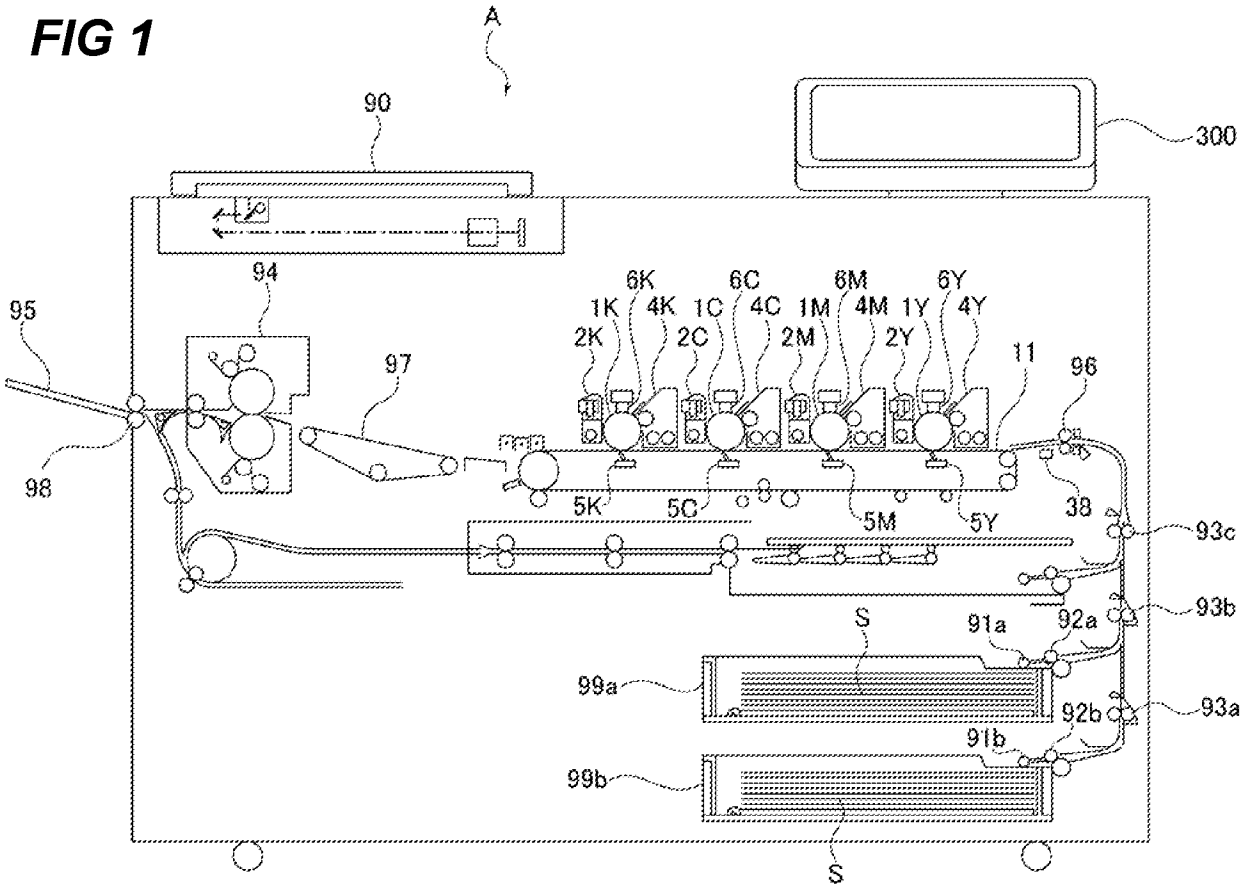
FIG. 1 is a diagram showing a schematic cross-sectional view of an image forming apparatus.

FIG. 1 is a schematic cross-sectional view of the image forming apparatus A. As shown in FIG. 1, the image forming apparatus A includes an image forming portion which forms an image on the sheet S. The image forming portion includes the photosensitive drums 1 (1Y, 1M, 1C, and 1K) as a photosensitive body (photosensitive drum), the charging devices 2 (2Y, 2M, 2C, and 2K), exposure heads 6 (6Y, 6M, 6C, and 6K), developing devices 4 (4Y, 4M, 4C, and 4K), and the transfer devices 5 (5Y, 5M, 5C, and 5K).

The image forming apparatus A is also equipped with a touch panel type operation portion 300 (detecting portion) with which a user can make various settings related to the image formation. With the operation portion 300, a user can specify the number of sheets for image formation, the size of the sheet on which the image is formed, the basis weight of the sheet S stored in the sheet cassettes 99*a* and 99*b* (by inputting the type of the sheet such as thick paper and plain paper, or brand of the sheet), and the like. Instead of inputting the basis weight of the sheet S, it may be measured by the sensor 38 (detection portion) disposed at the conveying path, for example.

For example, an optical sensor of the transmission type can be used for the sensor 38 for measuring the basis weight. The transmission type optical sensor is configured by the combination of an LED element at the light emission side and a light reception element such as a photodiode. When the light emitted from the LED element toward the light reception element is blocked by a document, the light amount received by the reception element decreases. The light reception element converts the amount of received light into a voltage value. By setting a predetermined threshold value for the voltage value, the light reception element functions as a switch.

In general, as the basis weight of paper used for printing and other purposes increases, the paper thickness also increases. Especially when thin paper with a small basis weight is used, the light emitted from an LED or another light emitting device penetrates the paper. On the other hand, when thick paper with a large basis weight is used, the light emitted from an LED or other light emitting device hardly penetrates the paper. By measuring the amount of received light from the LED element at the leading end portion or the trailing end portion of the document passing through the sensor with the amount of light emission from the LED being constant, the basis weight of the conveyed document can be predicted using the relationship between the transmission light and the basis weight of the document. This measuring position is adopted for increasing the prediction accuracy because the leading end portion and the trailing end portion of the document are seldom used for printing.

Figure 10:
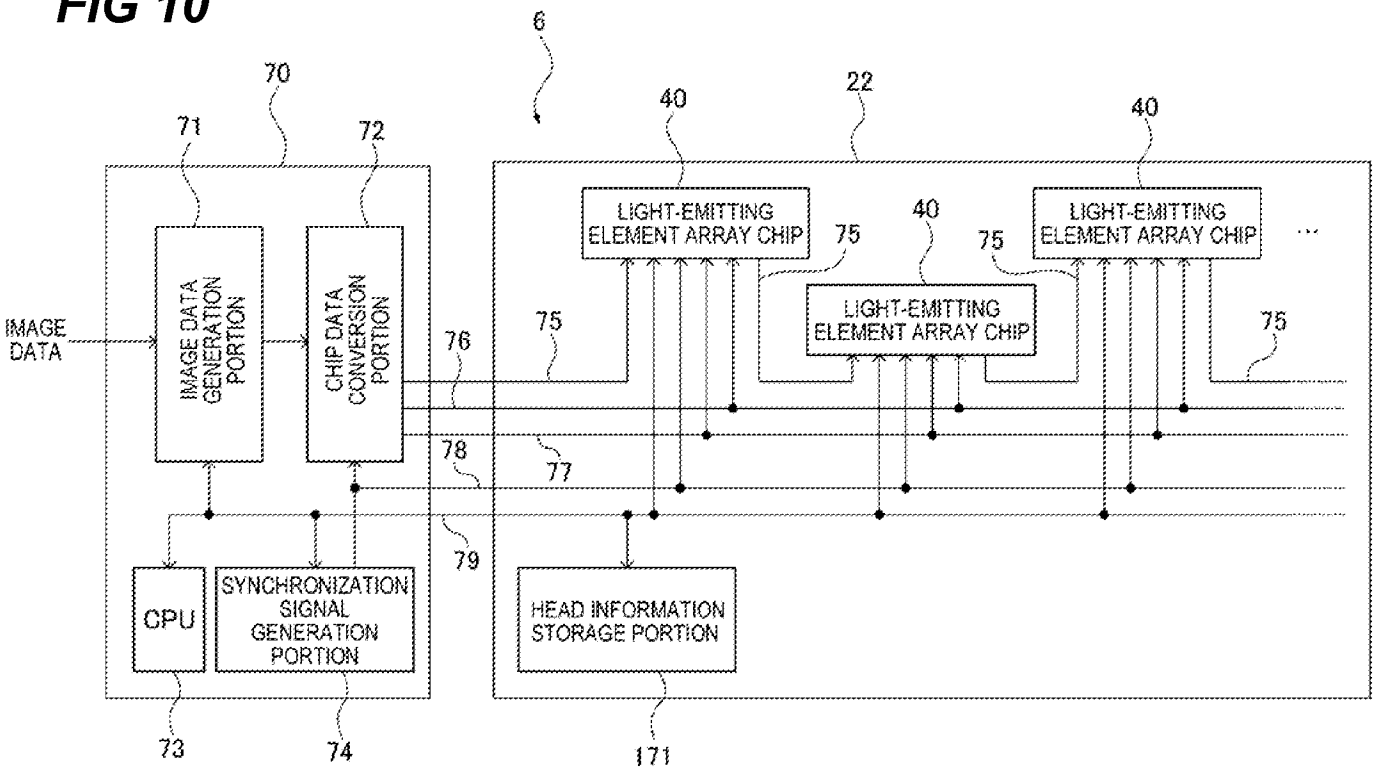
FIG. 10 is a block diagram showing the system configuration of an image controller portion and an exposure head.

The CPU 73 (setting portion) shown in FIG. 10 is electrically connected to the operation section 300. The CPU 73 controls the rotation speed of the various rollers that convey the sheet S and sets the conveying speed of the sheet S during image formation of the sheet S according to the basis weight of the sheet S inputted by the operation portion 300 or measured by the sensor 38. The "conveying speed" referred to here is defined as the speed of the sheet when it passes through the fixing device 94. For example, when performing the low-speed mode for forming an image on thick paper such as the sheet S whose basis weight is greater than a predetermined value, the CPU 73 controls the image forming apparatus to form images by setting the conveying speed of sheet S to a speed lower than that when performing the normal mode for forming images on plain paper as the sheet S whose basis weight is less than the predetermined value. The conveying speed of the sheet S depends on the rotational speed of the photosensitive drum 1, so that the CPU 73 sets the rotational speed of the photosensitive drum 1 to a lower speed when performing the low-speed mode (second mode) than that when performing the normal mode (first mode). This configuration allows the fixing device 94 to heat the toner image borne on the sheet S with a large basis weight for a longer period of time. As a result, more heat is applied to the toner image and the sheet S, so that the toner image is stably fixed even on the sheet S with a large heat capacity. The timing when the CPU 73 switches between the low-speed mode and the normal mode is not limited to the above. For example, the CPU 73 may be configured to set the low-speed mode when forming an image of higher quality than normal, and to increase the resolution in the sub-scanning direction, which is the direction of rotation of the photosensitive drum 1, compared to the normal mode.

Next, the image forming operations by the image forming apparatus A will be described. When forming an image, the sheet S accommodated in the sheet cassette 99*a* or 99*b* is first sent to the registration roller 96 by the pickup rollers 91*a* and 91*b*, the feed rollers 92*a* and 92*b*, and the conveying rollers 93*a* to 93*c*. Thereafter, the sheet S is sent to the conveying belt 11 at a predetermined timing by the registration roller 96.

On the other hand, in the image forming portion, the surface of the photosensitive drum 1Y is first charged by the charging device 2Y. Next, the exposure head 6Y irradiates the surface of the photosensitive drum 10Y with light in accordance with the image data read by the image reading portion 90 or the image data transmitted from an external device not shown in the figure) to form an electrostatic latent image on the surface of the photosensitive drum 10Y. Thereafter, the developing device 4Y attaches the yellow toner to the electrostatic latent image formed on the surface of the photosensitive drum 1Y to form a yellow toner image on the surface of the photosensitive drum 1Y. By applying a transfer bias to the transfer device 5Y, the toner image formed on the surface of the photosensitive drum 1Y is transferred to the sheet S that is being conveyed by the conveying belt 11.

By the same process, the photosensitive drums 1M, 1C, and 1K are irradiated with light by the exposure heads 6M, 6C, and 6K to form electrostatic latent images, and the magenta, cyan, and black toner images are respectively formed by the developing devices 4M, 4C, and 4K. Then, by applying transfer biases to the transfer devices 5M, 5C, and 5K, these toner images are superimposed onto the yellow toner image on the sheet S. As a result, a full-color toner image corresponding to the image data is formed on the surface of the sheet S.

After that, the sheet S bearing the toner image is conveyed by the conveying belt 97 to the fixing device 94 where it is heated and pressured. As a result, the toner image on the sheet S is fixed to the sheet S. After that, the sheet S on which the toner image is fixed is discharged by the discharge roller 98 to the discharge tray 95.

<Exposure Head>

Next, the configuration of the exposure head will be described.

Figure 2A:
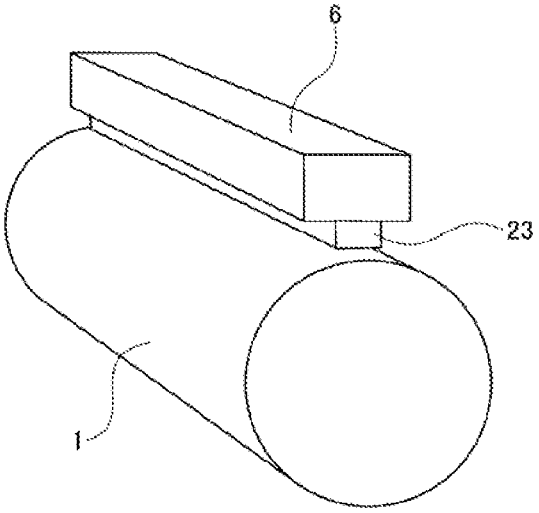
FIG. 2A is a diagram showing a perspective view of a photosensitive drum and an exposure head and FIG. 2B is a diagram showing a cross-sectional view of them.
Figure 2B:
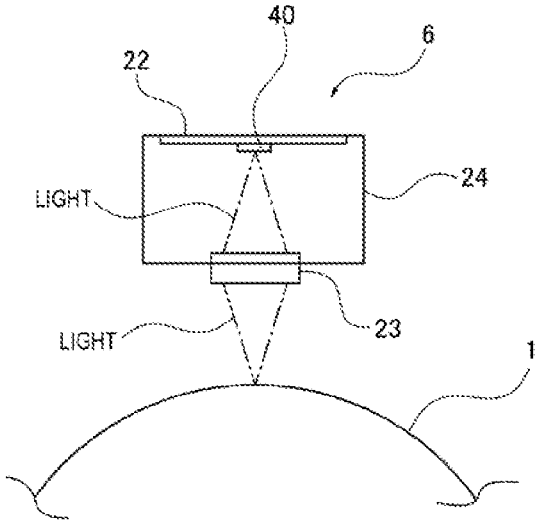
Figure 3A:
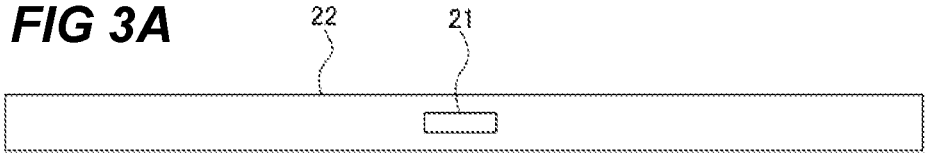
FIGS. 3A, 3B, and 3C show a mounting surface of a printed circuit board provided in the exposure head.
Figure 3B:
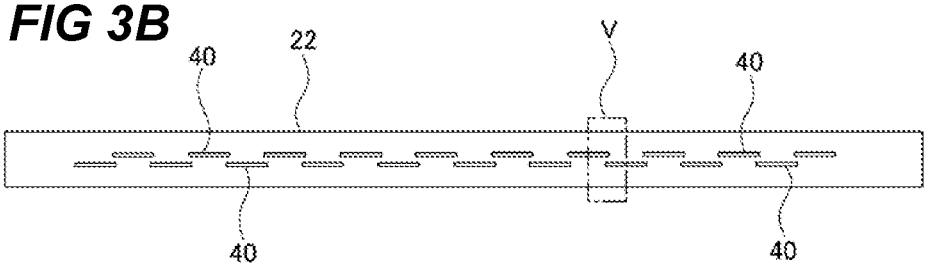
Figure 3C:
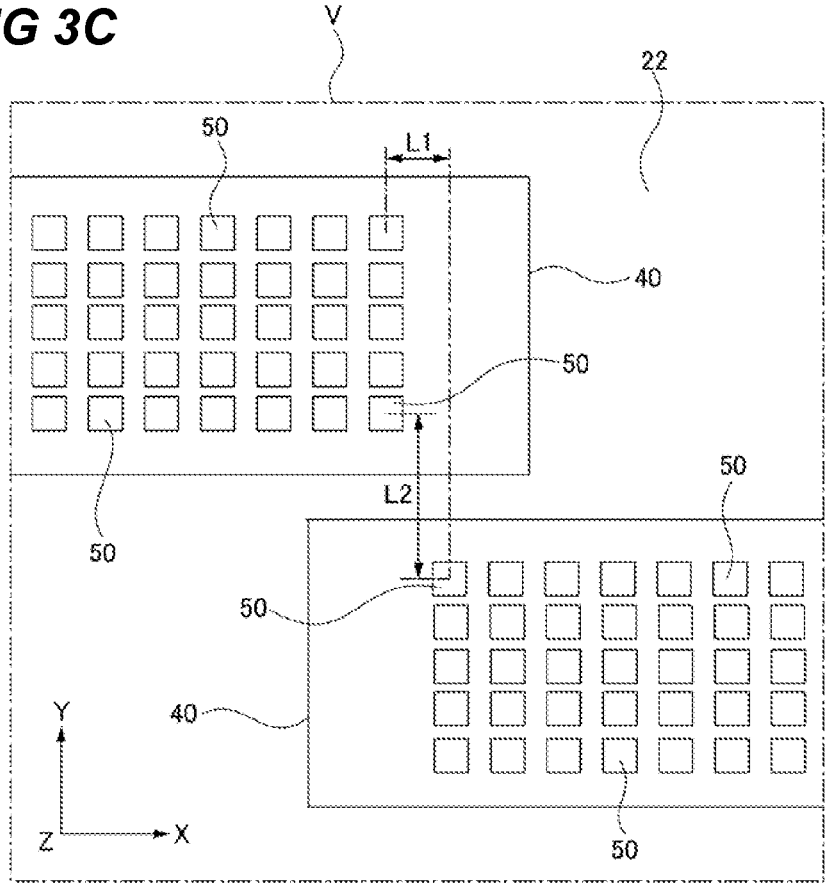

FIG. 2A shows a perspective view of the photosensitive drum 1 and the exposure head 6. FIG. 2B shows a cross-sectional view of the photosensitive drum 1 and the exposure head 6. FIG. 3A and FIG. 3B respectively show the mounting surfaces of one side and the other side of the printed circuit board 22 provided in the exposure head 6. FIG. 3C shows an enlarged view of the area V shown in FIG. 3B.

As shown in FIGS. 2A and 2B, the exposure head 6 is fixed at a position facing the surface of the photosensitive drum 1 by a fixing member (not shown). The exposure head 6 includes the printed circuit board 22, the light-emitting element array chips 40 for emitting light mounted on the printed circuit board 22, the rod lens array 23 that images (focuses) the light emitted from the light emitting element array chips 40 onto the photosensitive drum 1, and the housing 24 to which the rod lens array 23 and the printed circuit board 22 are fixed.

The connector 21 is mounted on the surface of the side of the printed circuit board 22 opposite to the surface on which the light-emitting element array chips are 40 are mounted. The connector 21 is provided to transmit control signals for the light emitting element array chips 40, which are transmitted from the image controller portion 70 (FIG. 10) and to connect the power supply line. The light-emitting element array chips 40 are driven via the connector 21.

As shown in FIG. 3B, 20 light-emitting element array chips 40 are mounted on the printed circuit board 22 in a staggered manner in double-row arrangement. In each light-emitting element array chip 40, 748 light-emitting portions 50 are arranged in the longitudinal direction (in the direction of the arrow X) in a predetermined resolution pitch. In each light-emitting element array chip 40, the light-emitting portions 50 are arranged in a predetermined pitch in the width direction (in the direction of the arrow Y). In other words, in each light-emitting element array chip 40, the light-emitting portions 50 are arranged two-dimensionally in the directions of the arrow X and the arrow Y.

In this embodiment, the above resolution pitch of the light-emitting element array chip 40 is 1200 dpi (about 21.16 μm). The distance from one end to the other end of 748 light-emitting portions 50 in the longitudinal direction of each light-emitting element array chip 40 is about 15.8 mm. In other words, the exposure head 6 has a total of 14960 light-emitting portions 50 in the direction of the arrow X. This makes it possible to perform an exposure process for an image with the width of approximately 316 mm (which is approximately 15.8 mm×20 chips) in the longitudinal direction.

In the longitudinal direction of the light-emitting element array chip 40, the interval L1 between the light-emitting portions 50 of the adjacent light-emitting element array chips 40 is approximately 21.16 μm. In other words, the pitch of the light-emitting portions 50 in the longitudinal direction at the boundary of the light-emitting element array chips 40 adjacent to each other is 1200 dpi resolution. In the width direction (the direction of the arrow Y) of the light-emitting element array chip 40, the interval L2 between the light-emitting portions 50 of the light-emitting element array chips 40 disposed in two rows is approximately 105 μm (equivalent to five pixels at 1200 dpi and ten pixels at 2400 dpi).

In this embodiment, the direction of the arrow X, which is the longitudinal direction of the light emitting element array chip 40, is the direction of the rotational axis of the photosensitive drum 1, and the direction of the arrow Y, which is the width direction of the light-emitting element array chip 40, is the rotational direction of the photosensitive drum 1. The direction of the arrow Z is the layered direction where layers of the layered structure of the light-emitting portion 50 described below are piled on each other. The longitudinal direction of the light-emitting element array chip 40 may be inclined by about ±1° to the direction of the rotational axis of the photosensitive drum 1. The width direction of the light-emitting element array chip 40 may also be inclined about ±1° to the rotational direction of the photosensitive drum 1.

As shown in FIG. 3C, the light-emitting element array chip 40 has a plurality of the light-emitting portions 50. In this embodiment, a plurality of light-emitting portions 50 are arranged along the direction of the arrow X in the light-emitting element array chip 40. The plurality of light-emitting portions 50 constitute a light-emitting row. In addition, the light-emitting element array chip 40 has a plurality of light-emitting rows lined up in the direction of the arrow Y. In this embodiment, there are five light-emitting rows composed of a plurality of the light-emitting portions 50.

<Rod Lens Array>

Next, the configuration of the rod lens array 23 will be described.

Figure 4B:
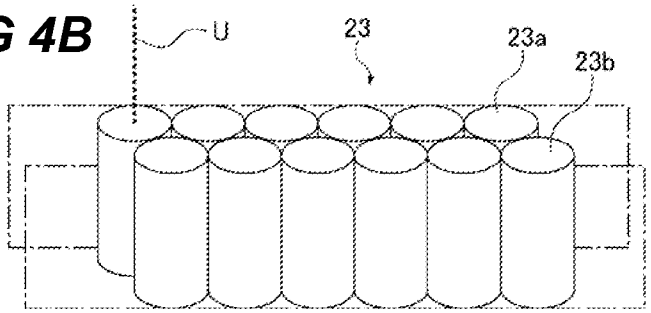
FIGS. 4A, 4B, and 4C show the configuration of a rod lens array.
Figure 4A:
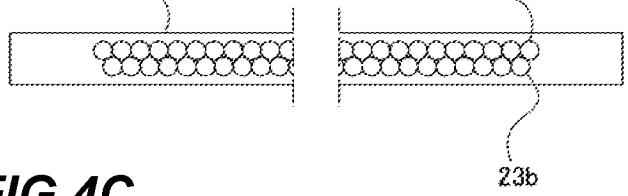
Figure 4C:
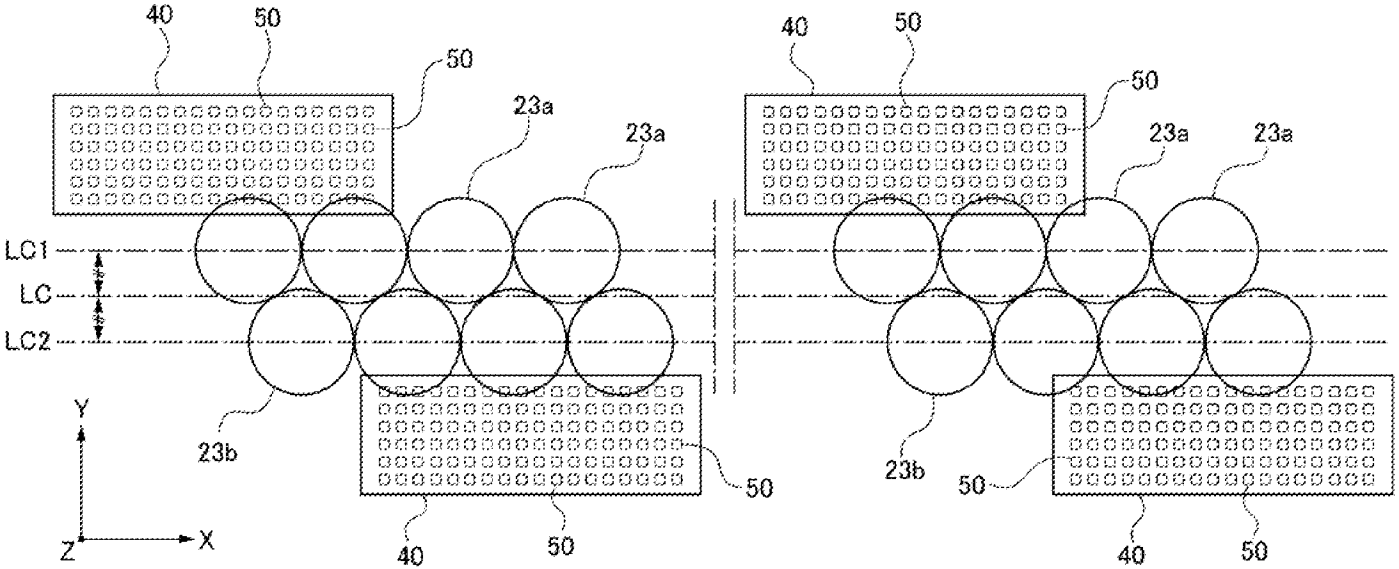

FIG. 4A shows a view of the rod lens array 23 viewed from the side of the photosensitive drum 1. FIG. 4B shows a schematic perspective view of the rod lens array 23. FIG. 4C shows the positional relationship between the rod lens array 23 and the light-emitting element array chips 40.

As shown in FIG. 4, the rod lens array 23 is a collection of a plurality of the rod lenses 23*a* and 23*b*. The rod lenses 23*a* and 23*b* are each a cylindrical lens made of glass and are arranged in two rows along the direction of the arrow X. The material of the lenses 23*a* and 23*b* is not limited to glass, but it may also be plastic. The lenses 23*a* and 23*b* are not limited to cylindrical, but they may also be polygonal, such as hexagonal.

Lenses 23*a* are located in the first row in the direction of the arrow Y, and lenses 23*b* are located in the second row in the direction of the arrow Y. These lenses 23*a* and 23*b* are arranged alternately such that one of the lenses 23*b* contacts both of two of the lenses 23*a* adjacent to each other in the direction of the arrow X and one of the lenses 23*a* contacts both of two of the lenses 23*b* adjacent to each other in the direction of the arrow X.

The lenses 23*a* and 23*b* have an incident surface on which light emitted from the light-emitting portions 50 is incident and an exit surface from which light incident on the incident surface exits. The dotted line shown in FIG. 4B indicates one of the optical axes U of the lenses 23*a* and 23*b*. The optical axes U of the lenses 23*a* and 23*b* (also referred to as the optical axes of the rod lens array 23) here means the lines connecting the centers of the light-emitting surfaces of lenses 23*a* and 23*b* with the focal points of the lenses 23*a* and 23*b*.

The housing 24 of the exposure head 6 holds the plurality of light emitting portions 50 and the rod lens array 23 such that the plurality of light emitting portions 50 respectively face the rod lens array 23. As a result, the light beams emitted from the plurality of light-emitting portions 50 are focused onto the photosensitive drum 1 by the rod lens array 23. In this embodiment, light beams emitted from a plurality of light-emitting portions 50 disposed in the direction of the directions of the arrows X and Y may pass through the same lens out of the lenses 23*a* and 23*b*. Further, light emitted from one of the light-emitting portions 50 may pass through some of the lenses 23*a* and 23*b* because the light diffuses radially. In other words, the light beams emitted from the plurality of the light-emitting portions 50 passes through some of the plurality of the lenses 23*a* and 23*b* included in the rod lens array 23 to expose the photosensitive drum 1.

As shown in FIG. 4C, when the rod lens array 23 is viewed from the photosensitive drum 1 side, the rod lens array 23 is placed so that a part of the rod lens array 23 overlaps with a part of the light-emitting element array chip 40. The virtual line LC1 is defined as a line that connects the optical axes U of the lenses 23*a* and the virtual line LC2 is defined as a line that connects the optical axes U of the lenses 23*b*. Then, the centerline LC (central axis line) in the sub-scanning direction of the rod lens array 23 is defined as a line which has the same distance from the virtual line LC1 and the virtual line LC2. When the rod lens array 23 is viewed from the side of the photosensitive drum 1, the light-emitting element array chips 40 are arranged such that the distance from the light-emitting element array chips 40 of the first row in the direction of the arrow Y to the centerline LC is equal to the distance from the light-emitting element array chips 40 of the second row to the centerline LC.

<Light-Emitting Element Array Chip>

Next, the configuration of the light-emitting element array chip 40 will be described.

Figure 5:
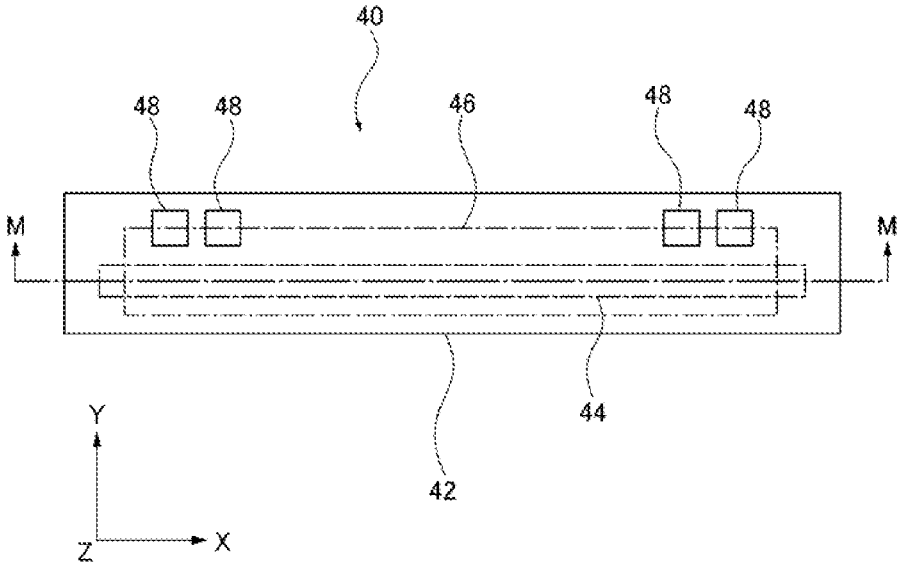
FIG. 5 is a schematic diagram of a light-emitting element array chip.
Figure 6:
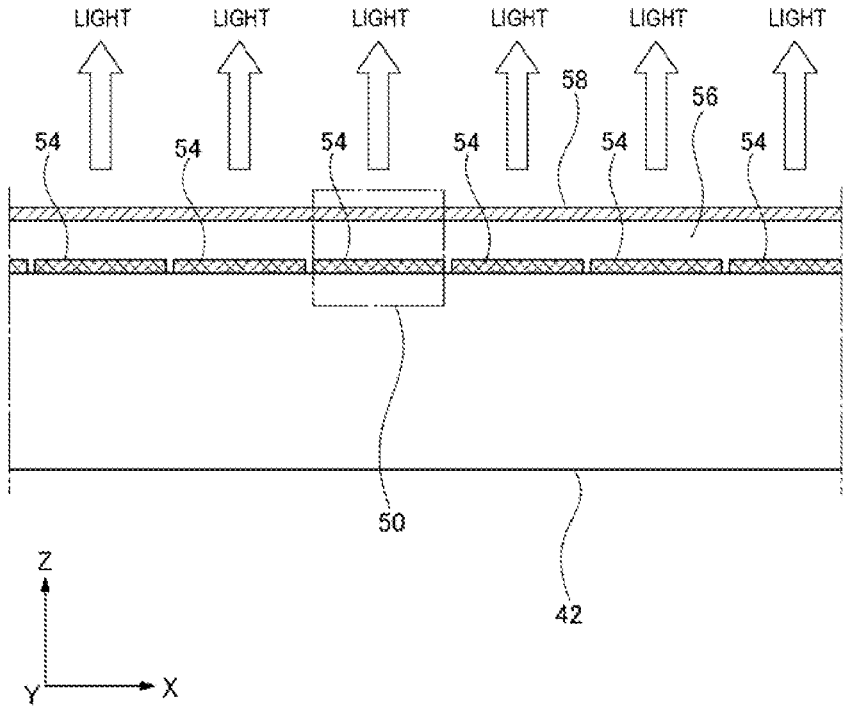
FIG. 6 is a diagram showing a cross-sectional view of the light-emitting element array chip.
Figure 7A:
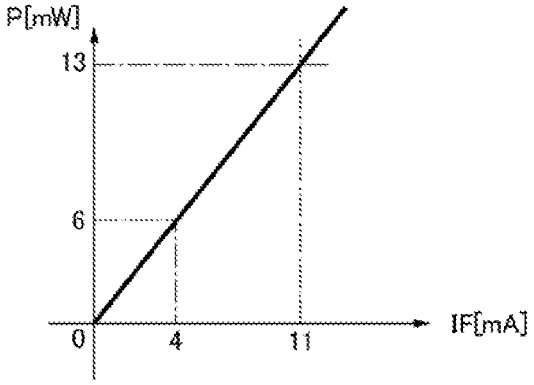
FIG. 7A is a graph showing current—light amount characteristics of a light-emitting portion.
Figure 7B:
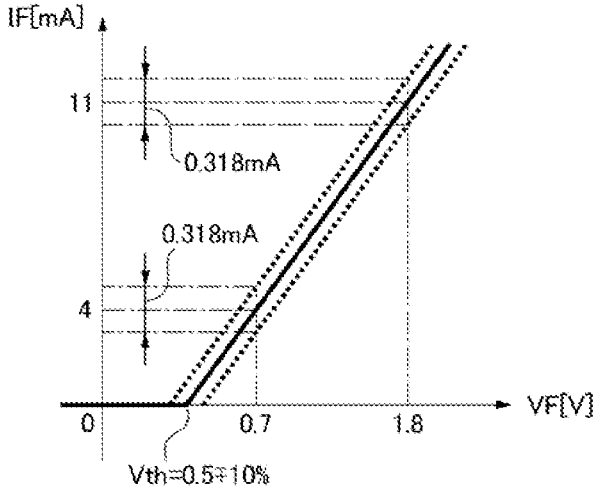
FIG. 7B is a graph showing the relationship between a forward voltage and a forward current.
Figure 8:
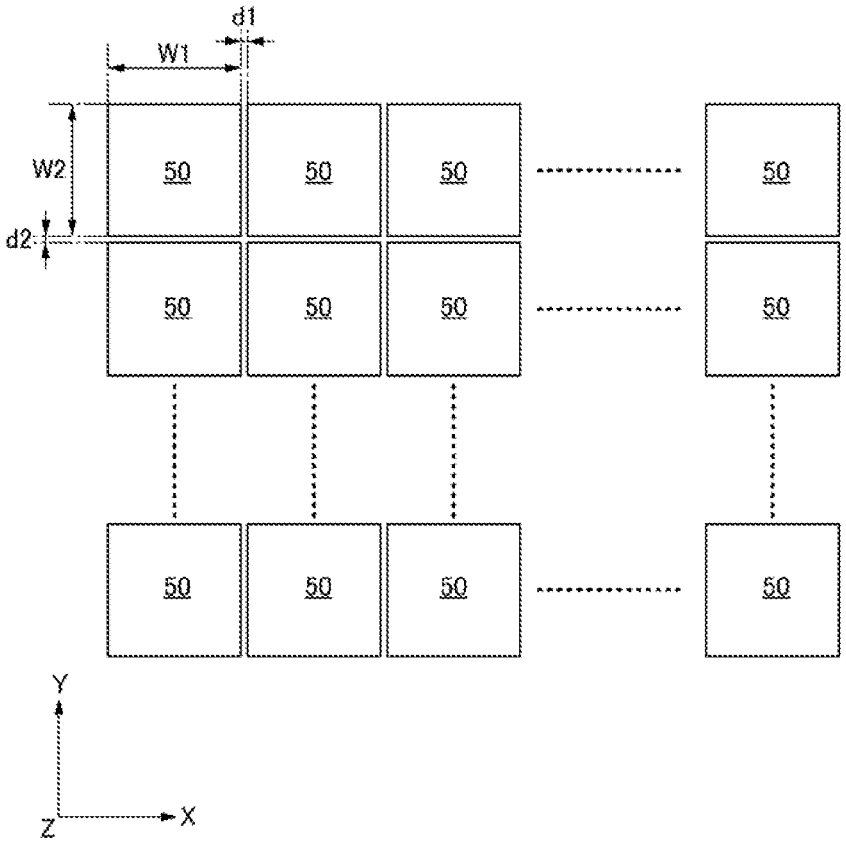
FIG. 8 is a schematic diagram for describing the arrangement of the light-emitting portions.

FIG. 5 shows a schematic view of the light-emitting element array chip 40. FIG. 6 shows a cross-sectional view cut at the M-M cross-section shown in FIG. 5. FIG. 7A is a graph showing the current and light amount characteristics of the light-emitting portion 50. FIG. 7B is a graph showing the relationship between the forward voltage VF applied to both ends of the light-emitting portion 50 and the forward current IF flowing through the light-emitting portion 50. FIG. 8 is a schematic diagram for describing the arrangement of the light-emitting portion 50.

As shown in FIG. 5, the light-emitting element array chip 40 has the light-emitting substrate 42 with the built-in circuit portion 46 for controlling the light-emitting portions 50, the light-emitting area 44 where a plurality of light-emitting portions 50 are regularly arranged on the light-emitting substrate 42, and the wire-bonding pads 48. The signal input and output between the outside of the light-emitting element array chip 40 and the circuit portion 46 and the power supply to the circuit portion 46 are performed via the wire-bonding pads 48. The circuit portion 46 may include an analog drive circuit, a digital control circuit, or a circuit with an analog drive circuit and a digital control circuit.

As shown in FIG. 6, the light-emitting portions 50 include the light-emitting substrate 42, the lower electrodes 54 arranged in a two-dimensional array on the light-emitting substrate 42 at certain intervals in the direction of the arrow X and the direction of the arrow Y (intervals d1 and d2 shown in FIG. 8), the light-emitting layer 56, and the upper electrode 58.

The lower electrodes 54 (the first electrode layer having a plurality of electrodes) are formed in a separated manner on the light-emitting substrate 42 as a layer and are respectively provided for pixels. In other words, each of the lower electrodes 54 is provided to form one pixel each.

The upper electrode 58 (second electrode layer) is stacked on the side of the light-emitting layer 56 opposite to the side where the lower electrodes 54 are provided. The light with the wavelength emitted from the light-emitting layer 56 is transmissible through the upper electrode 58.

The circuit portion 46 (control portion) controls the potential of the lower electrode 54 selected based on a control signal generated according to the image data, and produces a potential difference between the selected lower electrode 54 and the upper electrode 58. When a potential difference occurs between the upper electrode 58, which is the anode, and the lower electrode 54, which is the cathode, electrons flow into the light-emitting layer 56 from the cathode and positive holes flow into the light-emitting layer 56 from the anode. The recombination of electrons and positive holes in the light-emitting layer 56 causes the light-emitting layer 56 to emit light.

The light emitted from the light-emitting layer 56 toward the upper electrode 58 transmits through the upper electrode 58 and exits from the upper electrode 58. The light emitted from the light-emitting layer 56 toward the lower electrode 54 is reflected from the lower electrode 54 to the upper electrode 58, and the reflected light also transmits the upper electrode 58 and exits from the upper electrode 58. In this way, the light exits from the light-emitting portion 50. There is a time difference in the exit timing between the light emitted directly from the light-emitting layer 56 toward the upper electrode 58 and the light reflected from the lower electrode 54 and exits from the upper electrode 58. However, the layer of the light-emitting portion 50 is extremely thin, so that the exit of the direct light and the exit of the reflected light may be regarded as almost simultaneous.

In this embodiment, the light-emitting substrate 42 is made of silicon. The upper electrode 58 is preferred to be transparent for the light with the wavelength emitted from the light-emitting layer 56. For example, a transparent electrode such as an electrode made from Indium Tin Oxide (ITO) may be used to achieve an aperture ratio of substantially 100%, so that the light emitted by the light-emitting layer 56 transmits the upper electrode 58 and exits from the upper electrode 58 as it is. In this embodiment, the upper electrode 58 is an anode commonly provided for all of the lower electrodes 54. However, upper electrodes 58 may be provided such that these upper electrodes 58 respectively corresponds to the lower electrodes 54 or each of the upper electrodes 58 corresponds to several of the lower electrodes 54.

As the light-emitting layer 56, an organic Electro-Luminescence (EL) film or an inorganic Electro-Luminescence (EL) layer can be used. When an organic EL film is used as the light-emitting layer 56, the light-emitting layer 56 may be a stacked structure that includes functional layers such as an electron transport layer, a positive hole transport layer, an electron injection layer, a positive hole injection layer, an electron blocking layer, and a positive hole blocking layer as necessary. The light-emitting layer 56 may be formed continuously in the direction of the arrow X, or the separate light-emitting layers 56 may be formed each of which has the same size as that of the lower electrodes 54. Further, all of the lower electrodes 54 may be divided into a plurality of groups, and the light-emitting layers 56 may be provided such that each of the light-emitting layers 56 is stacked on the upper surfaces of the lower electrodes 54 which belong to one of the divided groups.

When using moisture-sensitive light-emitting materials such as an organic EL layer or an inorganic EL layer as the light-emitting layer 56, it is desirable to seal the light-emitting area 44 to prevent moisture from entering. For sealing, a sealing film is formed which includes a single layer or stacked layers of a thin film of, for example, silicon oxide, silicon nitride, or aluminum oxide. For forming a sealing film, methods such as Atomic Layer Deposition (ALD) method are preferable that excel in covering a structure such as steps. The materials, configuration, and forming method of the sealing film are not limited to the above-described examples, and suitable ones may be selected as needed.

The lower electrode 54 is preferably made of a metal that has high reflectivity for light with the wavelength emitted from the light-emitting layer 56. For example, Ag, Al, or an alloy of Ag and Al is used as the lower electrode 54. The lower electrode 54 and the circuit portion 46 are formed using the Si process, and the lower electrode 54 is directly connected to the driving portion of the circuit portion 46. By forming the lower electrodes 54 by the Si process, the lower electrodes 54 can be precisely and densely arranged since the process rule is highly precise at about 0.2 μm. Furthermore, since the lower electrodes 54 can be arranged in high density, most of the light-emitting area 44 can emit light, and the utilization efficiency of the light-emitting area 44 can be increased. The organic material of the light-emitting layer 56 is filled between the lower electrodes 54, so that the lower electrodes 54 are separated each other by the organic material.

As shown in FIG. 7A, the forward current IF flowing into the light-emitting portion 50 and the amount P of the emitted light are roughly proportional to each other. Therefore, the light amount of the light-emitting portion 50 can be controlled by controlling the forward current IF flowing to the light-emitting portion 50. However, such a current drive circuit tends to be larger and more complex. Therefore, the drive circuit of the light-emitting portion 50 of this embodiment controls the voltage applied to both ends of the light-emitting portion 50. As shown in FIG. 7B, the light-emitting portion 50 has a threshold voltage Vth. When the forward voltage VF applied to both ends of the light emitting portion 50 exceeds the threshold voltage Vth, the forward current IF starts to flow into the light emitting portion 50, and thereafter the forward current IF flows almost linearly.

Since the threshold voltage Vth of each light-emitting portion varies, the voltage at which the forward current IF starts to flow in each light-emitting portion is slightly different. Therefore, in the stage before the product is shipped from the factory, the light-emitting portions 50 of the light-emitting element array chip 40 are individually and sequentially lit, and the forward current IF flowing to each light-emitting portion 50 is adjusted so that the light beam focused through the rod lens array 23 is of a predetermined light amount. In the stage before the product is shipped from the factory, in addition to the above-described light amount adjustment, the focus adjustment is performed in the exposure head 6, in which the distance between the light-emitting element array chip 40 and the rod lens array 24 is adjusted.

As shown in FIG. 8, the light-emitting portions 50 are arranged in the light-emitting area 44 in a matrix with predetermined intervals in the direction of the arrow X and the direction of the arrow Y. In this embodiment, the width W1 of the light-emitting portion 50 in the direction of the arrow X is 20.90 μm, and the distance d1 between adjacent light-emitting portions 50 in the direction of the arrow X is 0.26 That is, the light-emitting portions 50 are arranged with a pitch of 21.16 μm (1200 dpi) in the direction of the arrow X. The width W2 of the light-emitting portion 50 in the direction of the arrow Y is 20.90 μm, which is equal to the width W1. That is, the light-emitting portion 50 of this embodiment has a square shape with one edge of 20.90 μm and an area of 436.81 $\mu m^2$, which occupies about 97.6% of the area of 447.7456 $\mu m^2$, which correspond to one pixel. The light amount obtained by organic light-emitting materials is lower than that by LEDs. However, by forming the light-emitting portion 50 as a square shape and decreasing the distance between adjacent light-emitting portions 50 as described above, it is possible to ensure a light emitting area enough for obtaining the light amount which can change the potential of the photosensitive drum 1.

It is desirable to ensure that the area of the light-emitting portion 50 is 90% or more of the area occupied by one pixel. Therefore, for an image forming apparatus A with an output resolution of 1200 dpi, it is desirable to form the light emitting portion 50 with its edge being about 20.07 μm or more. Further, for an image forming apparatus A with an output resolution of 2400 dpi, it is desirable to form the light emitting portion 50 with its edge being about 10.04 μm or more. The shape of the light-emitting portion 50 is not limited to a square. A polygon with more than four angles, a circle, an oval can be adopted as long as it emits light with an exposure area size corresponding to the output resolution of the image forming apparatus A and the quality of output images meets the design specifications of the image forming apparatus A. The distance d2 between adjacent light-emitting portions 50 in the direction of the arrow Y and the number of rows of light-emitting portions 50 in the direction of the arrow Y are determined based on the scanning speed of the exposure head 6, the amount of light required for the exposure process, and the resolution.

Figure 9A:
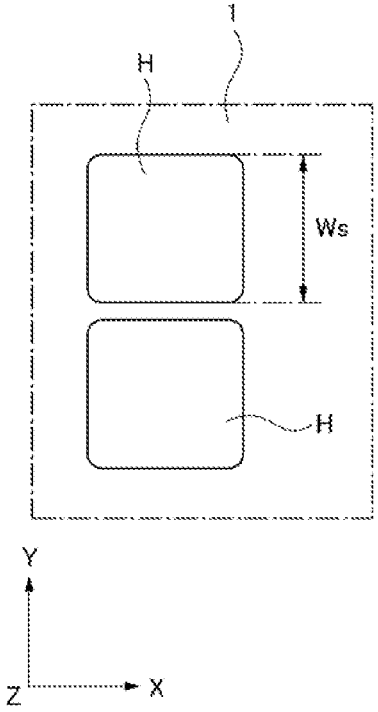
FIGS. 9A and 9B are schematic diagrams for describing the irradiated position on the photosensitive drum with light emitted from two light-emitting portions adjacent to each other in the sub-scanning direction.
Figure 9B:
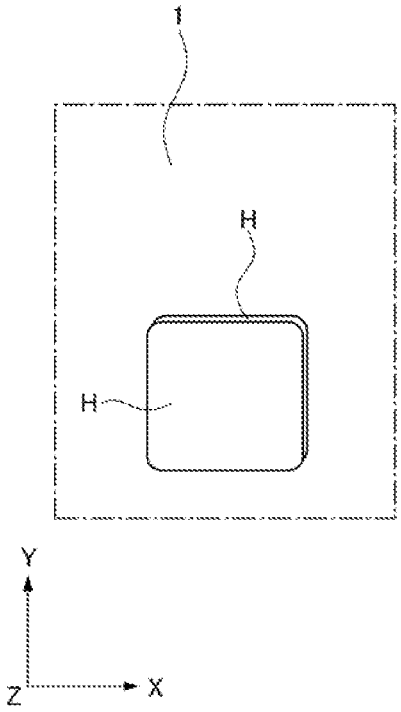

FIGS. 9A and 9B are schematic diagrams for describing the irradiation position on the photosensitive drum 1 of light emitted from two adjacent light-emitting portions 50 in the direction of the arrow Y. As shown in FIG. 9A, when two light-emitting portions 50 located adjacent to each other in the Y direction are lit simultaneously, the positions of the light spots H on the photosensitive drum 1 irradiated with light emitted from the two light emitting portions 50 shift to each other in the rotational direction of the photosensitive drum 1 (the direction of the arrow Y, sub-scanning direction) similarly to the positional relationship of the two light-emitting portions 50. On the other hand, as shown in FIG. 9B, when the timings of the lighting of the two light-emitting portions 50 are changed according to the rotation speed of the photosensitive drum 1, the positions of the light spots H irradiated with light emitted from the two light-emitting portions 50 on the photosensitive drum 1 can be made almost identical. As described above, irradiating the almost same position on the photosensitive drum 1 with the light beams from the light-emitting portions 50 arranged in the direction of the arrow Y is called multiple exposures. When the multiple exposures are performed, the greater the number of light-emitting portions 50 arranged in the direction of the arrow Y used for the multiple exposures becomes, the greater the amount of light received by a portion of the photosensitive drum 1 becomes. In this embodiment, a light amount of about 13 mW can be obtained per one light-emitting portion 50, so when the number of light-emitting portions 50 used for multiple exposures is n, a light amount of 13n (mW) can be obtained. In this embodiment, the light amount of each light-emitting portion 50 when the region corresponding to one pixel on the photosensitive drum 1 is multiply exposed is the same at about 13 mW. However, the "same" here means that the deviation of 10% is allowed for the amount of light emitted by each light-emitting portion 50. In other words, when the average light amount of all the light-emitting portions 50 during image formation is 13 mW and the light amount of all the light-emitting portions 50 are within the range of 11.7 to 14.3 mW, the light amount of the light-emitting portions 50 is regarded as the same as each other.

In order to match the positions of the light spots on the photosensitive drum 1 irradiated with light emitted from two light-emitting portions 50 adjacent to each other in the direction of the arrow Y, it is necessary to delay the timing of lightening of the light-emitting portion 50 downstream in the direction of rotation of the photosensitive drum 1 by the delay time amount T relative to the timing of lighting of the light-emitting portion 50 upstream in the direction of rotation of the photosensitive drum 1. The delay amount T (μs) is calculated using the following Equation 1, where the rotational speed of the photosensitive drum 1 is Vdr (mm/s), the width of the light-emitting portion 50 in the direction of the arrow Y is W2 (μm), and the interval between adjacent light-emitting portions 50 in the direction of the arrow Y is d2 (μm).

$$T=((W2+d2)\div 1000)\div Vdr \quad \text{(Equation 1)}$$

In this embodiment, the light is generated from the light-emitting portion 50 such that the maximum value Tw (μs) of the time of lightening of the light-emitting portion 50 is equal to the time corresponding to one line in the sub-scanning direction. The maximum value Tw (μs) is expressed by the following Equation 2 based on the resolution of 1200 dpi and the rotational speed Vdr (mm/s) of the photosensitive drum 1.

$$Tw=(25.4\div 1200)\div Vdr \quad \text{(Equation 2)}$$

It is ideal that the positions of the light spots irradiated with the light emitted from the light emitting portions 50 arranged in the direction of the arrow Y on the photosensitive drum 1 overlap completely. However, due to variations in control, it is difficult to completely realize the timing of the delay amount T. Therefore, the delay amount T should be controlled at timing that is placed within the allowable deviation amount ΔT (μs) calculated by the following Equation 3, where the spot size, which is the length in the sub-scanning direction of the irradiation area on the photosensitive drum 1 of the light emitted from the light-emitting portion 50 is Ws (μm).

$$\Delta T=(Ws\div 1000)\div Vdr \quad \text{(Equation 3)}$$

<System Configuration of Exposure Head>

Next, the configuration of the exposure head 6 and the image controller portion 70 that controls the exposure head 6 will be described. The image controller portion 70 is provided on the main body of the image forming apparatus A. Although the control procedure performed when the image data for a single color is processed will be described in the following, the same processes are performed in parallel for the image data corresponding to yellow, magenta, cyan, and black when performing image formation operations.

FIG. 10 is a block diagram of the system configuration of the image controller portion 70 and the exposure head 6. As shown in FIG. 10, the image controller portion 70 is equipped with the image data generation portion 71, the chip data conversion portion 72, the CPU 73, and the synchronization signal generation portion 74. With these parts, the image controller portion 70 processes image data, generates image formation timing, and send control signals to control the exposure head 6.

The image data generation portion 71 receives the image data of a document read by the image reading portion 90 or image data transferred from an external device via the network. The image data generation portion 71 dithers the input image data at the resolution instructed by the CPU 73, and generates image data for outputting images.

The synchronization signal generation portion 74 generates a line synchronization signal that represents the separation of each line of the image data. The CPU 73 informs the synchronization signal generation portion 74 of the time interval of the one-line signal cycle. The one-line signal cycle is determined as the cycle in which the surface of the photosensitive drum 1 moves for a pixel size of 1200 dpi in the direction of rotation as one line cycle based on the preset rotation speed of the photosensitive drum 1. For example, if the photosensitive drum 1 rotates at 200 mm/s, the CPU informs of the time interval of 105.8 μs as one line cycle.

The chip data conversion portion 72 divides the image data for one line into the number of the light-emitting element array chips 40 in synchronization with the line synchronization signal generated by the synchronization signal generator 74 and input via the line synchronization signal line 78. The chip data conversion portion 72 then transmits the image data for one line along with the clock signal and a chip selection signal representing the effective ranges of image data to the light-emitting element array chips 40 via the chip selection signal line 75, the clock signal line 76 and the image data signal line 77.

The head information storage portion 171 provided in the exposure head 6 is connected to the CPU 73 via the communication signal line 79. The head information storage portion 171 stores the amount of light emitted by the light-emitting element array chips 40 and the mounting position information as head information. The light-emitting element array chips 40 light the light-emitting portions 50 based on the set values of the signals input from the image controller portion 70. The light-emitting element array chip 40 also generates a chip selection signal that are used by another light emitting element array chip 40 connected via the chip selection signal line 75.

<System Configuration of Light-Emitting Device Array Chip>

Next, the system configuration of the light-emitting element array chip 40 will be described.

Figure 11:
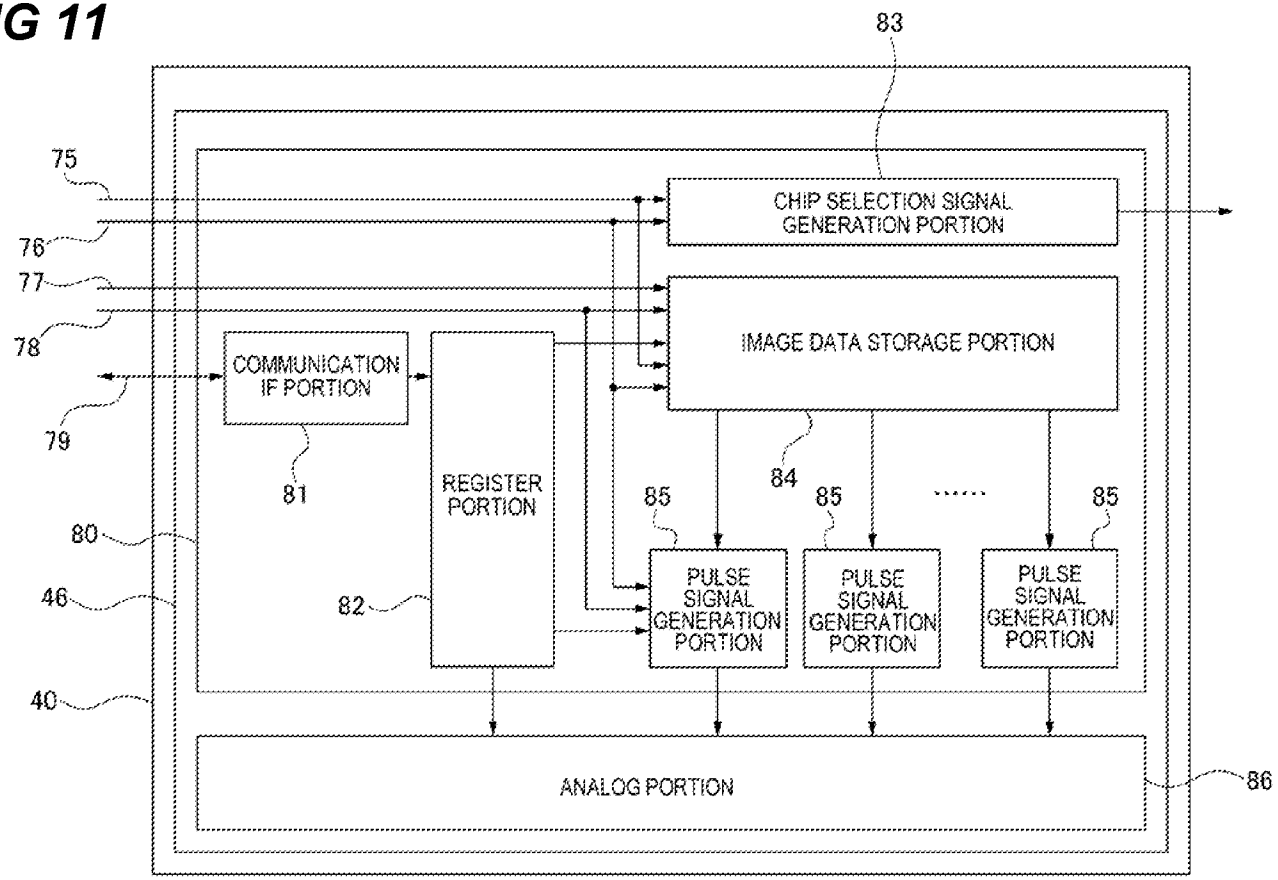
FIG. 11 is a block diagram showing the system configuration of the light-emitting element array chip.

FIG. 11 is a block diagram showing the system configuration of the light-emitting element array chip 40. As shown in FIG. 11, the circuit portion 46 of the light-emitting element array chip 40 includes the digital portion 80 and the analog portion 86. The analog portion 86 generates a signal for driving the light-emitting portions 50 based on pulse signals generated by the digital section 80 as described below.

The digital portion 80 includes the communication IF (interface) portion 81, the register portion 82, the chip selection signal generation portion 83, the image data storage portion 84, and the pulse signal generation portion 85. With these parts, the digital portion 80 generates and transmits to the analog portion 86 pulse signals for lighting the light-emitting portions 50 based on the setting values preset by a communication signal in synchronization with the clock signal, a chip selection signal, an image data signal, and a line synchronization signal.

The chip selection signal generation portion 83 delays the input chip selection signal and generates chip selection signals that is used by other light-emitting element array chips 40 connected via the chip selection signal line 75.

The register portion 82 stores the exposure timing information used by the image data storage portion 84, the pulse signal width information and the pulse signal phase information (delay information) generated by the pulse signal generation portion 85, and the drive current setting information set by the analog portion 86. The communication IF portion 81 controls the writing and reading of set values to and from the register portion 82 based on the communication signal input by the CPU 73.

The image data storage portion 84 holds the image data while the input chip selection signal is valid, and outputs the image data to the pulse signal generation portion 85 in synchronization with the line synchronization signal. The pulse signal generation portion 85 generates and outputs to the analog portion 86 a pulse signal for controlling the timing to turn on the light-emitting portion 50 based on the pulse signal width information and the pulse signal phase information set in the register portion 82 according to the image data input from the image data storage portion 84.

<Image Data Storage Portion>

Next, the operations of the image data storage portion 84 will be described. In the following description, the chip selection signal cs and the line synchronization signal lsync are expressed as negative logic signals. However, these signals may be expressed as positive logic signals.

Figure 12:
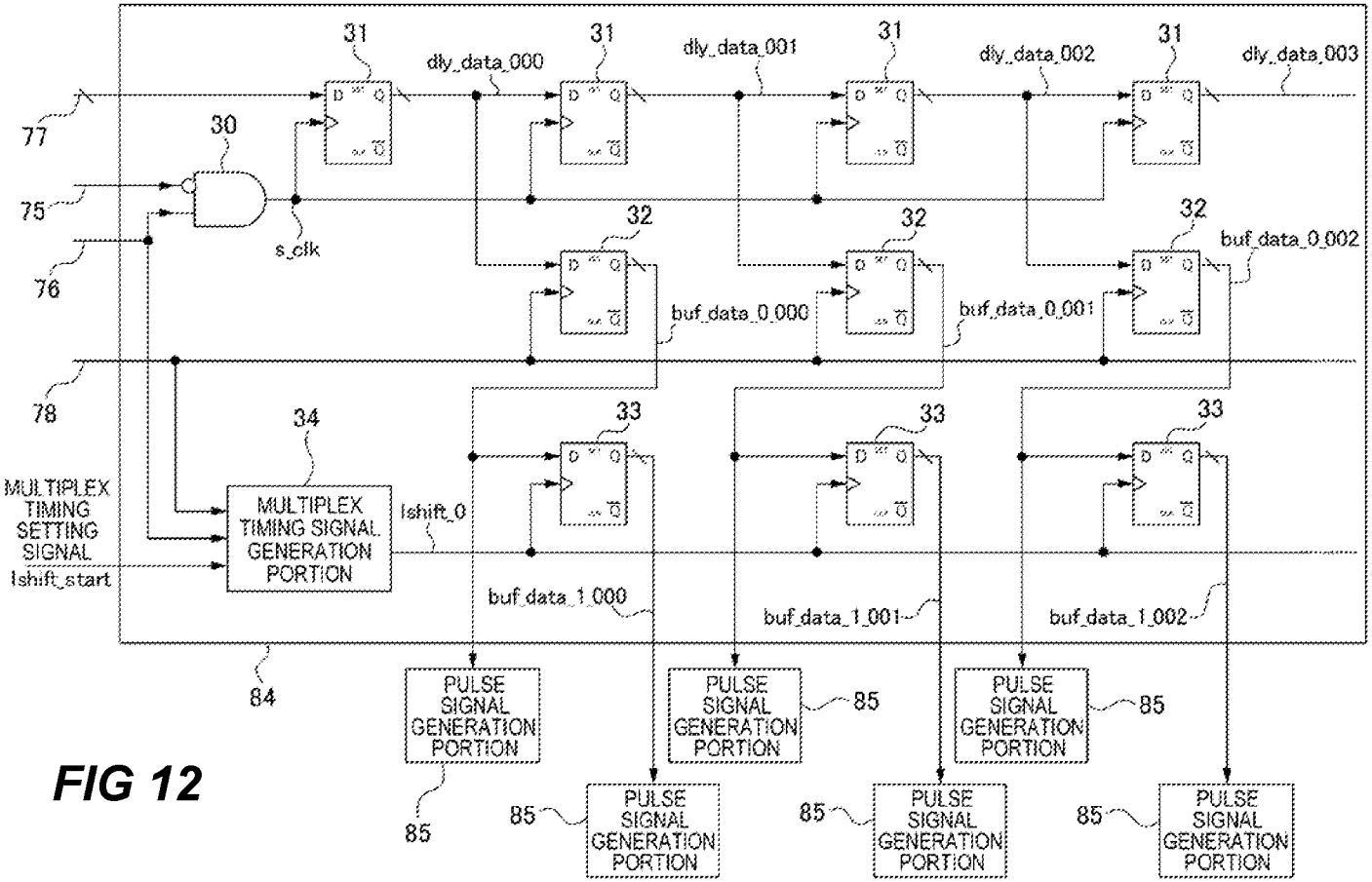
FIG. 12 is a circuit diagram of an image data storage portion.

FIG. 12 is a diagram showing the circuit configuration of the image data storage portion 84. As shown in FIG. 12, the clock gate circuit 30 outputs the logical product of the inverted signal of the chip selection signal cs and the clock signal clk, thereby outputting the clock signal s_clk to the flip-flop circuit 31 only when the chip selection signal cs is valid. The image data storage portion 84 includes the same number (which is 748) of the flip-flop circuits 31 which are connected in series as that of the light-emitting portions 50 provided in the longitudinal direction of the light-emitting element array chip 40. The image data signal data input to the image data storage portion 84 is input to the first one of the series-connected flip-flop circuits 31.

The flip-flop circuits 31 operate based on the clock signal s_clk sent from the clock gate circuit 30. The output signals of the flip-flop circuits 31 are respectively input to the flip-flop circuits 32, and the flip-flop circuits 32 operate based on the line synchronization signal lsync. The output signals of the flip-flop circuits 32 are input to the pulse signal generation portions 85 and the flip-flop circuits 33 as image data buf_data_0_000 to buf_data_0_747. The output signals of the flip-flop circuits 32 are respectively input to the flip-flop circuits 33, and the flip-flop circuits 33 operate based on the multiplex timing signal lshift_0. The output signals of the flip-flop circuits 33 are respectively input to the pulse signal generation portions 85 as image data buf_data_1_000 to buf_data_1_747.

The multiplex timing signal generation portion 34 generates the multiple exposure timing signal lshift_0 based on the line synchronization signal lsync, the clock signal clk, and the multiplex timing setting signal lshift_start. In this embodiment, the signal lshift_0 is generated by delaying the line synchronization signal lsync for a cycle or cycles indicated by the value set by the multiplex timing setting signal lshift_start. For example, when the signal lshift_start is set as lshift_start=1, the multiplex timing signal lshift_0 is obtained by delaying the line synchronization signal lsync by one cycle of the clock signal clk.

Figure 13:
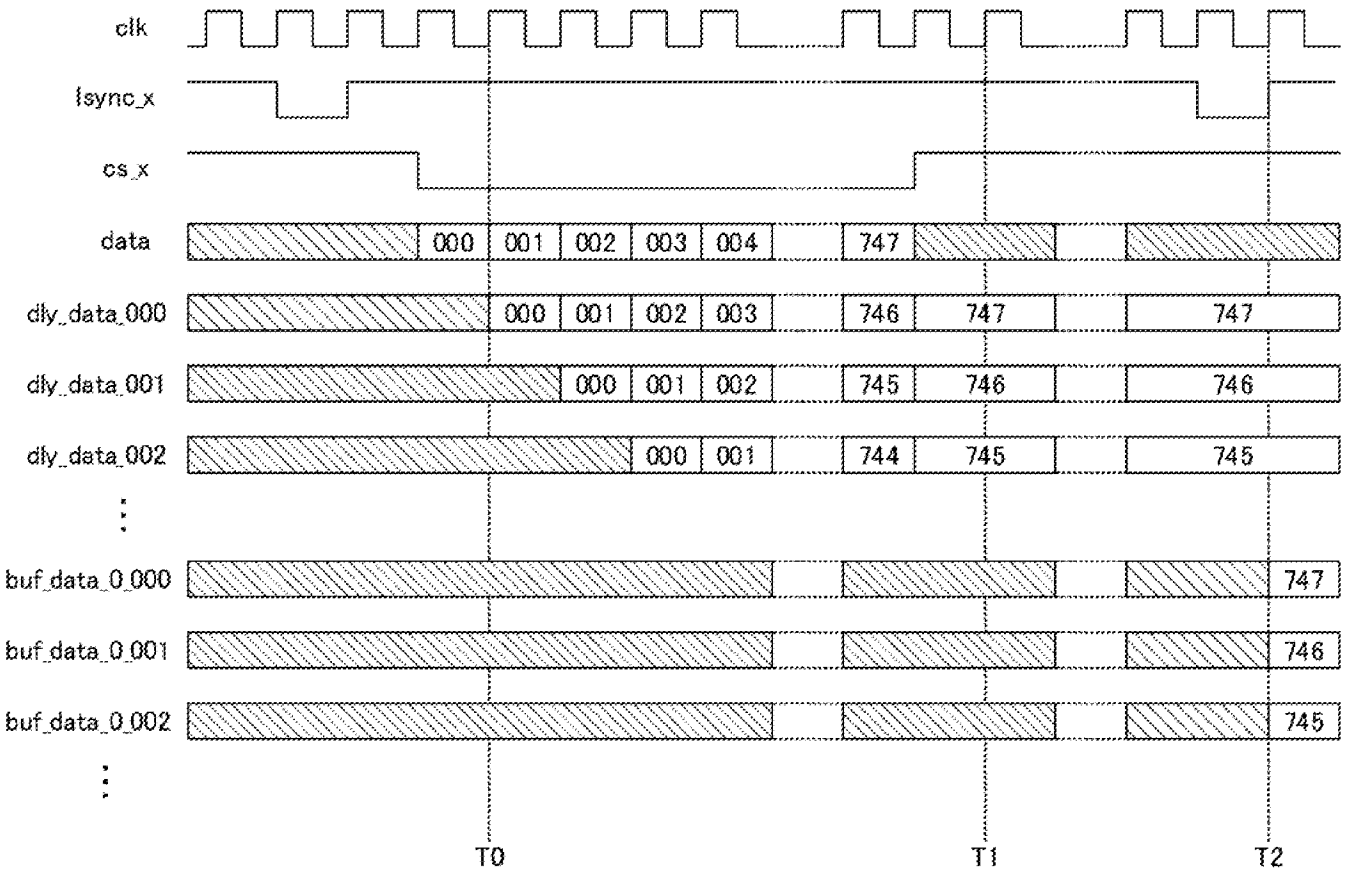
FIG. 13 is a timing chart showing operations in the image data storage portion for the main scanning direction.

FIG. 13 is a timing chart showing the operations in the main scanning direction in the image data storage portion 84. The meanings of symbols shown in FIG. 13 is the same as those shown in FIG. 12. As shown in FIG. 13, during the period from the time T0 when the chip selection signal cs is detected such that the value of the signal cs=0 at a leading edge of the clock signal clk and to the time T1, the image data signal is shifted in the order of data→dly_data_000→dly_data_001. The same number (which is 748) of clock pulses in which the value of the signal cs=0 as the number of the light-emitting portions 50 in the main scanning direction are input, thereby storing image data for one line as dly_data_000 to dly_data_747.

After the time T1, the shift operation of the image data is not performed while the image data is held since the value of the chip selection signal cs=1. After the line synchronization signal lsync is detected such that the value of the signal lsync=0 at a leading edge of the clock signal clk at the time T2, the image data for one line is simultaneously output like dly_data_000→buf_data_0_000, dly_data_001→buf_data_0_001 to the pulse signal generation portions 85 as the signals buf_data_0_000 to buf_data_0_747.

Figure 14:
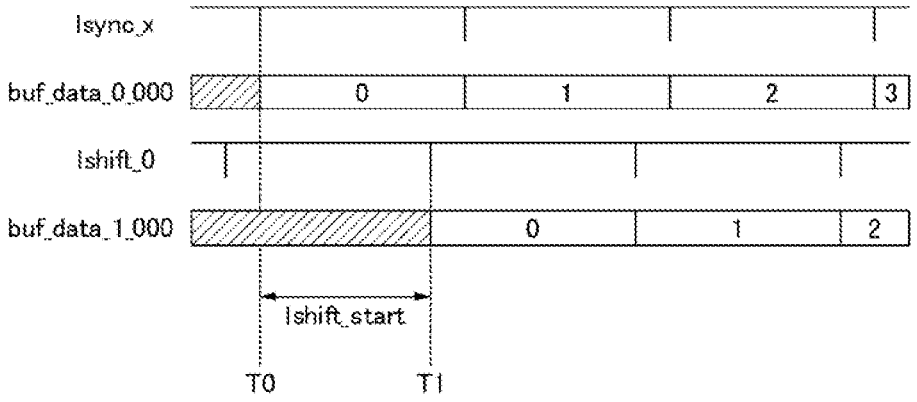
FIG. 14 is a timing chart showing operations in the image data storage portion for the sub-scanning direction.

FIG. 14 is a timing chart showing the operations in the sub-scanning direction in the image data storage portion 84. The meanings of symbols shown in FIG. 14 is the same as those shown in FIG. 12. The output signal buf_data_0_000 of the flip-flop circuit 32 and the output signal buf_data_1_000 of the flip-flop circuit 33, which are shown in FIG. 12 are described as representatives in the following using FIG. 14. Signals buf_data_0_001 to buf_data_0_747 and buf_data_1_001 to buf_data_1_747 are the same as above and the descriptions are omitted below.

As shown in FIG. 14, when the value 0 of the line synchronization signal lsync is input to the flip-flop circuit 32 at the time T0, the value of the signal dly_data_000 is output as the signal buf_data_0_000. When the value 0 of the signal lshift_0 is input to the flip-flop circuit 33 at the time T1, the value of the signal buf_data_0_000 is output to the pulse signal generation portion 85 as the signal buf_data_1_000.

In this way, the data that was output to the pulse signal generation portion 85 as the signal buf_data_0_000 when the value of the signal lsync=0 is output to the pulse signal generation portion 85 again as the signal buf_data_1_000 at the next timing when the signal lshift_0=0. The multiple exposures are realized by providing the signal buf_data_0_000 to the light-emitting portions 50 that perform the preceding exposure on the photosensitive drum 1 and by providing the signal buf_data_1_000 to the light-emitting portions 50 that perform succeeding exposure on the photosensitive drum 1.

In the above description, the configuration has been described in which the photosensitive drum 1 is multiply exposed by two light-emitting portions 50 adjacent to each other in the sub-scanning direction. However, the number of the light-emitting portions 50 in the sub-scanning direction used for multiple exposures is not limited to two, and three or more light-emitting portions 50 may be used. In this case, by increasing the number of flip-flop circuits 32 and 33 according to the number of light-emitting portions 50 used for multiple exposures, it is possible to hold data corresponding to three or more light-emitting portions 50. Further, by increasing the number of pulse signal generation portions 85 connected to the flip-flop circuits according to the number of light-emitting portions 50 used for multiple exposures, the lighting timing of each of the three or more light-emitting portions 50 can be controlled.

Further, in the present embodiment, the flip-flop circuits have been used as the configuration for holding the data of the light-emitting portions 50. However, the invention is not limited to this configuration. That is, for example, memory circuits such as RAMs may be used to hold the data of the light-emitting portions 50. However, it is preferable that the flip-flop circuits are arranged in parallel with the light-emitting portions 50 as in the present embodiment. This makes it possible to form a simple circuit with a small wiring area.

<Analog Portion>

Next, the configuration of the analog portion 86 will be described. In the following description, only the two drive portions 61 that drive the two light-emitting portions 50 will be described. However, all the light-emitting portions 50 are driven in the same manner.

Figure 15:
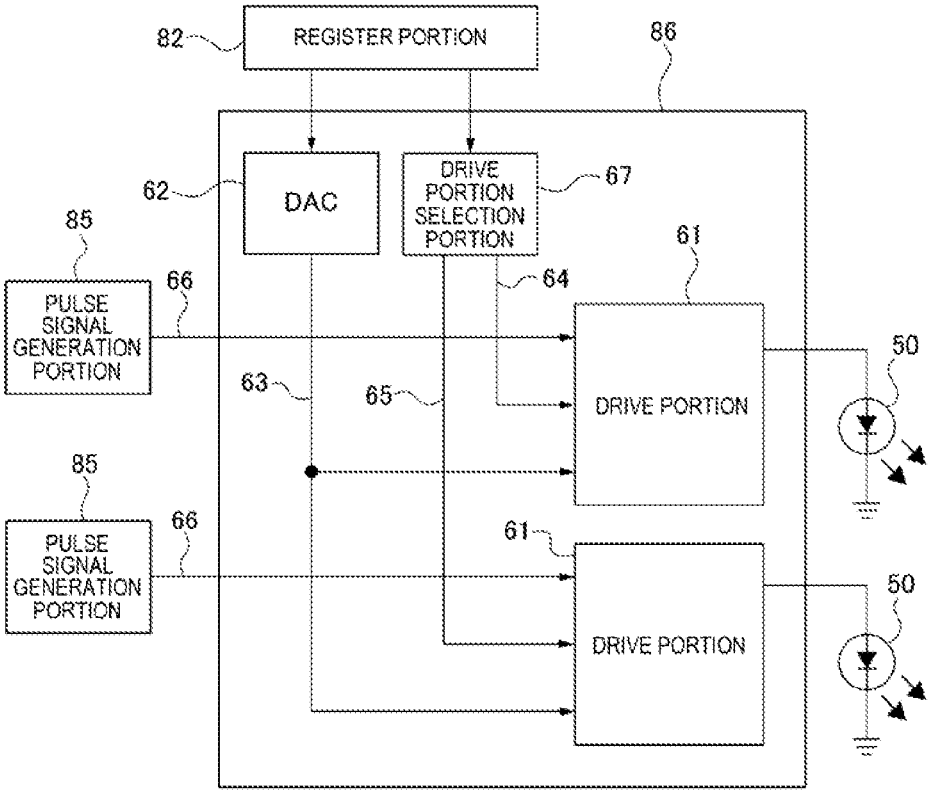
FIG. 15 is a block diagram showing the configuration of an analog portion.

FIG. 15 is a block diagram showing the configuration of the analog portion 86. As shown in FIG. 15, the analog portion 86 includes the drive portions 61 that drive the light-emitting portions 50, the DAC 62 (digital-to-analog converter), and the drive portion selection portion 67.

Based on the data set in the register portion 82 to the drive portion 61, the DAC 62 supplies the analog voltage that determines the drive current via the signal line 63. The pulse signals generated by the pulse signal generation portions 85 are input to the drive portions 61 via the signal lines 66. In this way, the analog voltages that determine the drive currents and the pulse signals are input to the drive portions 61. The drive portions 61 then control the drive currents and lightening times of the light-emitting portions 50 based on the analog voltages and the pulse signals by means of the drive circuits described below.

Based on the data set in the register portion 82, the drive portion selection portion 67 supplies drive selection signals that select one between the drive portions 61 to the two drive portions 61 via signal lines 64 and 65. Here, the drive portion selection signals are generated such that only the signal connected to the selected drive portion 61 has a High-level voltage. For example, when the upper drive portion 61 out of the drive portions 61 shown in FIG. 15 is selected, a High-level voltage is supplied only to the signal line 64, and a Low-level voltage is supplied to the signal line 65. An analog voltage from DAC 62 that determines the drive current is set in each drive portion 61 when the drive portion selection signal indicates a High-level voltage. The CPU 73 sequentially selects one of the drive portions 61 via the register portion 82. Then, by setting analog voltages to the selected drive portions 61 one after another, the analog voltages of all the drive portions 61 are set with only the single DAC 62.

Figure 16:
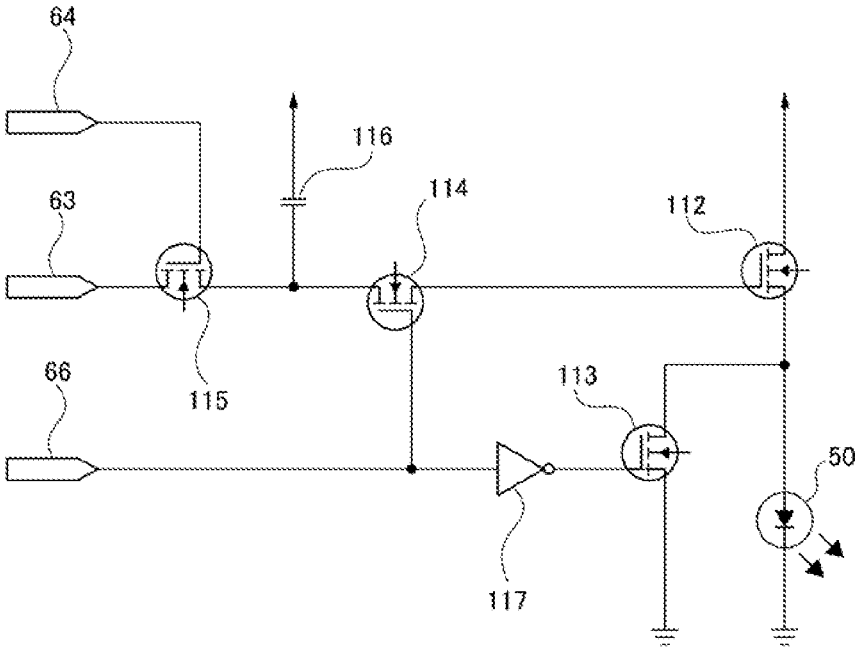
FIG. 16 is a circuit diagram of the drive portion.

Next, the configuration of the drive portion 61 will be described. FIG. 16 is a circuit diagram of the drive portion 61. As shown in FIG. 16, the drive portion 61 includes MOSFETs (Metal Oxide Semiconductor Field Effect Transistor) 112 to 115, the capacitor 116, and the inverter 117.

The MOSFET 112 supplies a drive current to the light-emitting portion 50 according to the value of the gate voltage, and controls the current such that the drive current is turned off (for lighting off) when the gate voltage is at a Low level. The gate of the MOSFET 114 is connected to the signal line 66. The MOSFET 114 applies the voltage charged in the capacitor 116 to the gate of the MOSFET 112 when the PWM (Pulse Width Modulation) signal input via the signal line 63 is at a High level.

The drive portion selection signal sent from the drive portion selection portion 67 is provided to the gate of the MOSFET 115 via the signal line 64. When the input drive portion selection signal is at a High level, the MOSFET 115 is turned on and the capacitor 116 is charged with the analog voltage output from the DAC 62 and transmitted via the signal line 63. In this embodiment, the DAC 62 sets an analog voltage in the capacitor 116 before the image formation, and the analog voltage level is being held by turning off the MOSFET 115 during the image formation.

As described above, the MOSFET 112 supplies to the light-emitting portion 50 the drive current according to the set analog voltage and the PWM signal. A slow turn off response speed due to large amount of input capacitance of the light-emitting portion 50 can be sped up by the MOSFET 113. The PWM signal is logically inverted by the inverter 117 and the logically inverted PWM signal is input to the gate of the MOSFET 113. When the PWM signal is at a Low level, a High-level signal is input to the gate of the MOSFET 113, thereby forcibly discharging the charge in the input capacitance of the light-emitting portion 50.

<Control of Light-Emitting Portion During Multiple Exposures>

As described above, the image forming apparatus A can change the conveying speed of the sheet S by performing the normal-mode or the low-speed mode. In other words, the image forming apparatus A changes the rotation speed of the photosensitive drum 1 during image formation by switching the settings of normal mode and low speed mode. When multiple exposures are performed in the low-speed mode, the time for the same part of the surface of the photosensitive drum 1 to be irradiated with light is longer than in the normal mode. As a result, the amount of light with which this same part is irradiated increases. This is because when the low-speed mode is performed, the rotation speed of the photosensitive drum is lower than when the normal mode is performed, so the time required for light with which the region is irradiated, which corresponds to one pixel on the surface of the photosensitive drum is longer. When the amount of light with which the region is irradiated, which corresponds to one pixel on the surface of the photosensitive drum 1 is increased in this way, there is a possibility that too much toner is attached when developing an electrostatic latent image.

Figure 17:
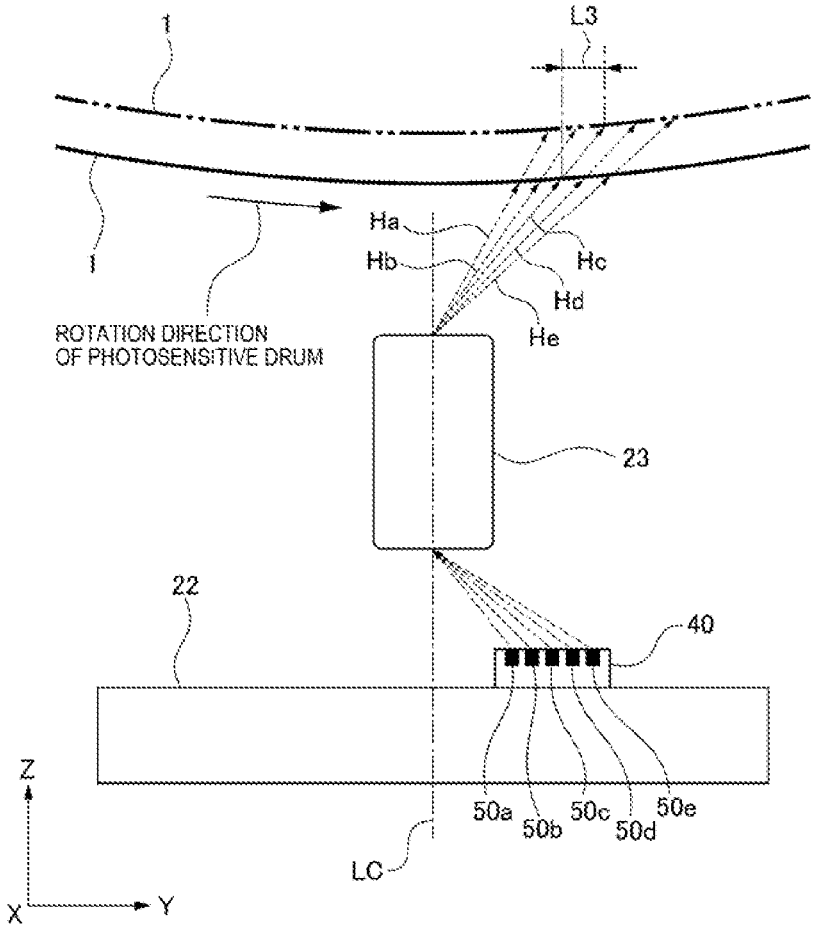
FIG. 17 is a schematic diagram of the light emitting portions and the photosensitive drum.

FIG. 17 is a schematic diagram showing the light-emitting portion 50 and the photosensitive drum 1. In the following, the control of the light-emitting portions 50 during multiple exposures will be described, taking an example of a configuration in which multiple exposures are performed using five light-emitting portions 50*a* to 50*e* adjacent to each other in the sub-scanning direction as shown in FIG. 17. In FIG. 17, the solid line indicates the photosensitive drum 1 at the ideal position defined in the design, and the double-dotted chain line indicates the photosensitive drum 1 at a position deviating from the ideal position due to maximum tolerance.

Figure 18A:
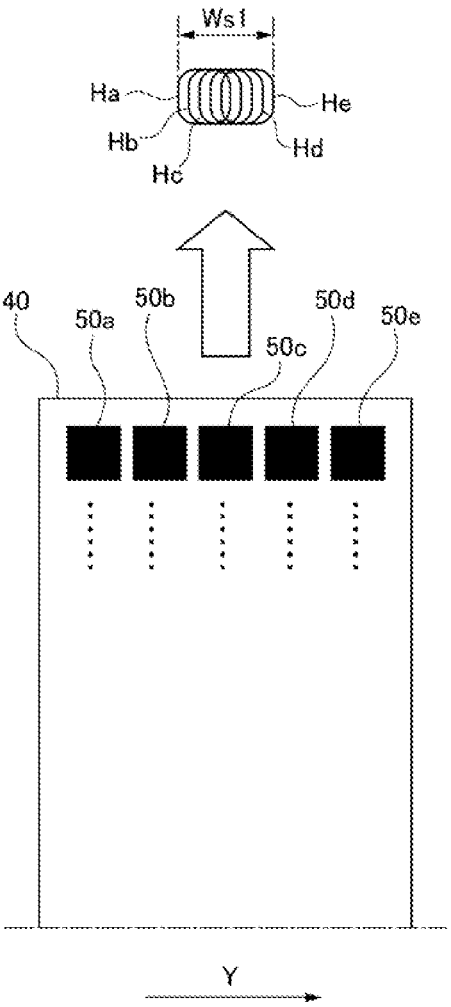
FIGS. 18A and 18B are schematic diagrams of the light-emitting portions and spots on the photosensitive drum of light irradiated with light emitted from the light-emitting portions.

FIG. 18A is a schematic diagram showing the light-emitting portions 50 and the light spots H on the photosensitive drum 1 irradiated with light emitted from the light-emitting portions 50 when multiple exposures are performed in the normal mode. When the image forming apparatus A forms an image in the normal mode, the exposure head 6 performs multiple exposures. In this case, the circuit portion 46 of the light-emitting element array chip 40 turns on all of the light-emitting portions 50*a* to 50*e* at predetermined timings respectively as shown in FIG. 18A. As a result, the light spots Ha to He on the same region of the surface of the photosensitive drum 1 are irradiated with the light emitted from the light-emitting portions 50*a* to 50*e*.

Figure 18B:
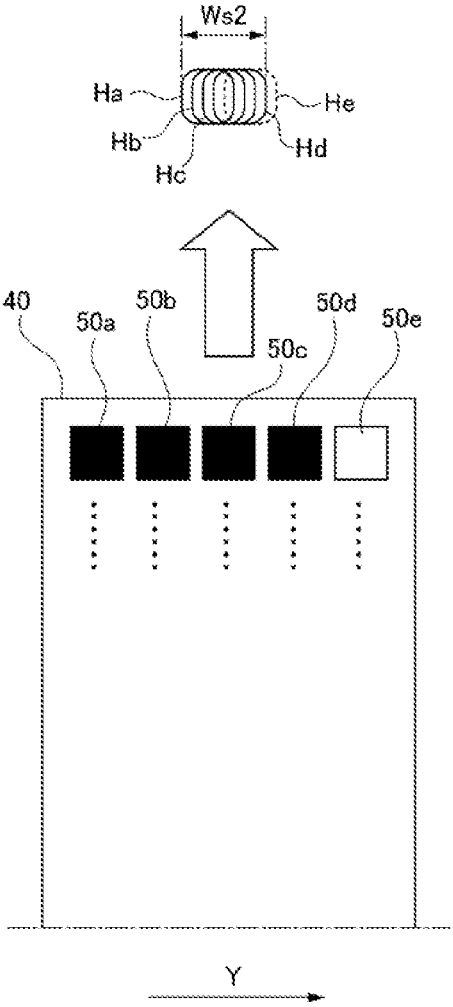
Figures 19A, 19B, 19C, 19D, 19E:
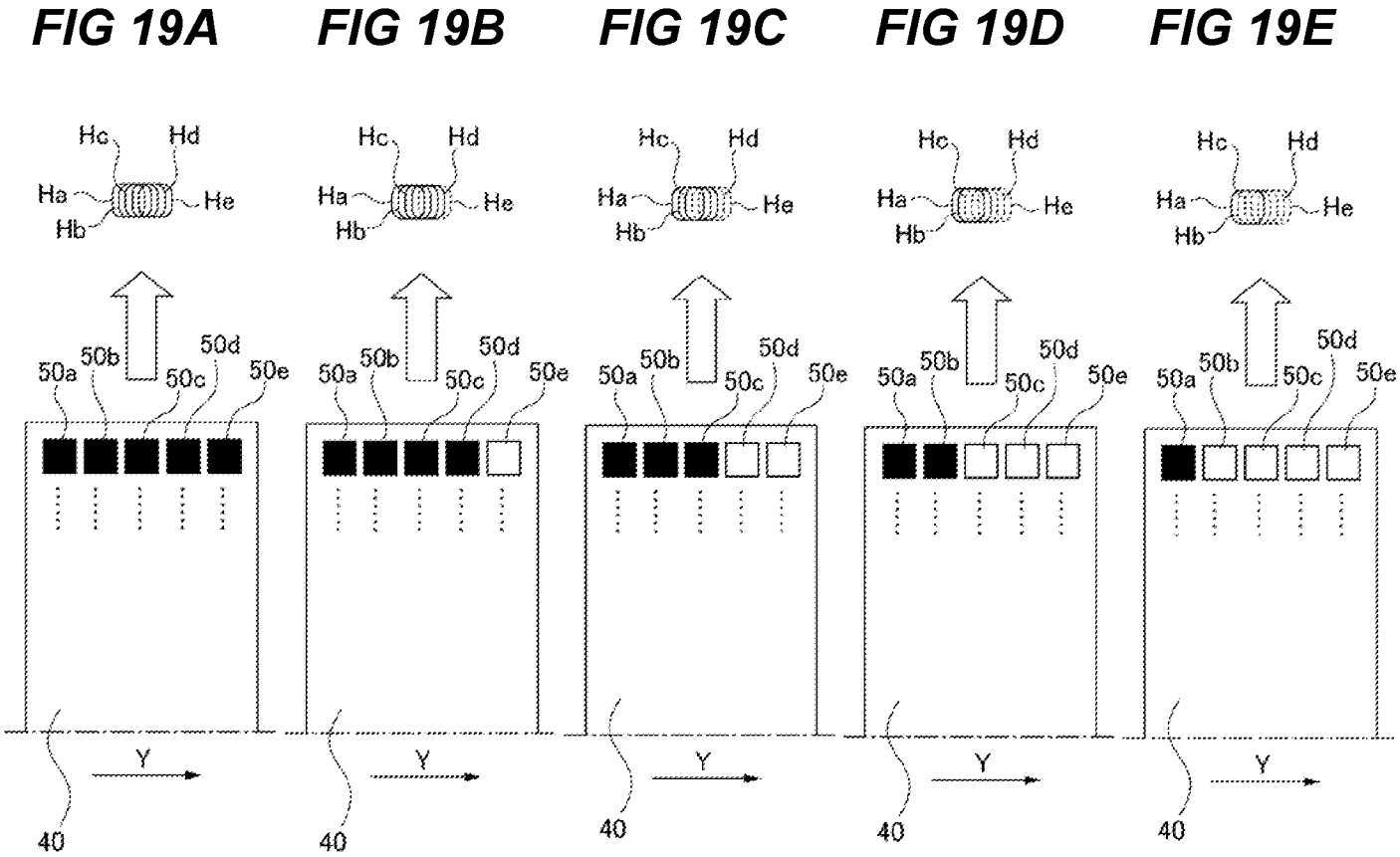
FIGS. 19A, 19B, 19C, 19D, and 19E are schematic diagrams of the light-emitting portions and spots on the photosensitive drum of light irradiated with light emitted from the light-emitting portions.

FIG. 18B is a schematic diagram showing the light-emitting portions 50 and the light spots H on the photosensitive drum 1 irradiated with light emitted from the light-emitting portions 50 when multiple exposures are performed in the low-speed mode. When the image forming apparatus A forms an image in the low-speed mode, the exposure head 6 performs multiple exposures. In this case, the circuit portion 46 of the light-emitting element array chip 40 turns on the light-emitting portions 50*a* to 50*d* at predetermined timings respectively out of the light-emitting portions 50*a* to 50*e* as shown in FIG. 18B. That is, when the low-speed mode is set, the circuit portion 46 performs multiple exposures without lighting the light-emitting portion 50*e* out of the light-emitting portions 50*a*-50*e* all of which are used for performing multiple exposures when the normal mode is set. In other words, the circuit portion 46 controls the application of voltages to the lower electrodes 54 such that the number of light-emitting portions 50 that emit light to the same region of the surface of the photosensitive drum 1 in the low-speed mode is less than the number of light-emitting portions 50 that emit light to the same region of the surface of the photosensitive drum 1 in the normal mode.

As described above, in the low-speed mode, the same region of the surface of the photosensitive drum 1 is irradiated with light from the light-emitting portions 50 for a longer time than in the normal mode. When multiple exposures are performed for the region corresponding to one pixel on the photosensitive drum 1 in this low-speed mode, the total amount of light with which this region is irradiated can be reduced by decreasing the number of light-emitting portions 50 used for multiple exposures. In this embodiment, in the normal mode, all five light-emitting rows are used to multiply expose the region corresponding to one pixel on the photosensitive drum 1, whereas in the low-speed mode, four of the five light emitting rows are used to multiply expose the region corresponding to one pixel on the photosensitive drum 1. Namely, the total amount of light for multiple exposures of the region corresponding to one pixel on the photosensitive drum 1 is about 4/5 in the low-speed mode as compared to that in the normal mode. Therefore, even when forming an image in the low-speed mode using multiple exposures, it is possible to suppress too much toner being placed on the photosensitive drum 1.

When performing the slow-speed mode, the configuration could be adopted in which the light amount of each light-emitting portion is reduced from that in the normal mode to suppress too much toner being attached. However, in the configuration where the light amount of the light-emitting portion is variable, the circuit configuration for driving the light-emitting portion becomes more complicated, which may lead to a higher cost and a larger size of the exposure head. By changing the number of light-emitting rows used for multiple exposures as in this embodiment, the total light amount in the region corresponding to one pixel on the photosensitive drum to be multiply exposed can be changed without changing the light amount of each light-emitting portion 50.

In order to reduce manufacturing costs, the same exposure head 6 may be used for image forming apparatuses with different conveying speeds (productivity) of the sheet S. A wide range of the light amount with which the same portion of the photosensitive drum 1 is irradiated is obtained when the exposure head 6 of this embodiment is used since a part of the light emitting portions 50 can be selected to be driven for performing the exposure process. Therefore, even when the exposure head 6 is used in different image forming apparatuses with different conveying speeds of the sheet S, the light amount can be adjusted in each image forming apparatus, thereby suppressing too much toner being attached on the photosensitive drum 1.

As shown in FIGS. 17, 18A and 18B, the positions of the light spots Ha to He on the photosensitive drum 1 irradiated with light emitted from multiple light-emitting portions 50*a* to 50*e* during multiple exposures are slightly shifted due to deviations in control. The shifts of the positions of the light spots are larger when the photosensitive drum 1 is located away farther from the light-emitting portions 50 than the ideal position due to the influence of tolerance. For example, as shown in FIG. 17, the light spot Hc irradiated with light on the photosensitive drum 1 located at the ideal position shifts by the distance L3 to that on the photosensitive drum 1 located at a position deviating from the ideal position due to the influence of tolerance. When the light spots irradiated with light shift in this way, the combined light spot size Ws, which is the length in the sub-scanning direction of the combined region of the light spots irradiated on the photosensitive drum 1 by multiple exposures becomes larger, and the sharpness of the dots that make up the image deteriorates, resulting in poor image quality.

In contrast, in this embodiment, when multiple exposures are performed in the low-speed mode, the combined light spot size Ws can be decreased by reducing the number of light emitting-portions 50 used for multiple exposures. That is, the combined light spot size Ws2 shown in FIG. 18B is smaller than the combined light spot size Ws1 shown in FIG. 18A since fewer number of light-emitting portions 50 are used for multiple exposures in the configuration in FIG. 18B than that in FIG. 18A. Thus, according to the configuration of this embodiment, the combined light spot size Ws can be decreased when the low-speed mode is performed, which leads to the improvement of the sharpness of the dots that make up an image and to enhance the image quality.

It has been found that the optical characteristics such as the amount of light reaching the photosensitive drum 1 and the shape of the light when the photosensitive drum 1 is irradiated with light emitted from the light-emitting portions 50 closer to the center line LC (center) in the sub-scanning direction of the rod lens array 23 are better than when the photosensitive drum 1 is irradiated with light emitted from the light-emitting portions 50 farther from the center line LC. Therefore, when performing multiple exposures in the low-speed mode, it is preferable to adopt the configuration in which the light-emitting portion 50*e*, which is the farthest from the center line LC in the sub-scanning direction of the rod lens array 23 among the light emitting sections 50*a* to 50*e* that perform multiple exposures when the normal mode is set is turned off during multiple exposures. With this configuration, the multiple exposures are performed by light-emitting portions 50*a* to 50*d* having good optical characteristics. thereby suppressing deterioration in image quality.

This embodiment is configured to perform multiple exposures using five light-emitting portions 50*a* to 50*e* when performing the normal mode, and four light-emitting portions 50*a* to 50*d* when performing the low-speed mode. However, the present invention is not limited to this embodiment, and the number of light-emitting portions 50 used for multiple exposures may be changed as appropriate according to the amount of light required for the exposure process. For example, the configuration can be adopted in which five light-emitting portions 50 are used for multiple exposures when performing the normal mode and three light-emitting portions 50 are used for multiple exposures when performing the low-speed mode. Even in this case, it is preferable to adopt the configuration in which the at least light-emitting portion 50*e*, which is the farthest from the center line LC in the sub-scanning direction of the rod lens array 23 is turned off when performing multiple exposures for the reason stated above. Further, if the amount of light required for the exposure process can be ensured, the configuration can be adopted in which a plurality of light-emitting portions 50 are used to perform multiple exposures when performing the normal mode and multiple exposures are not performed when performing the low-speed mode.

The image forming apparatus A may also be configured such that the rotation speed of the photosensitive drum 1 is changed in a stepwise fashion according to the basis weight of the sheet S and the number of pixels in the sub-scanning direction by the CPU 73. Even in such a case, it is preferable for the same reason as above to adopt the configuration in which the light-emitting portions 50 are sequentially turned off from the light-emitting portion 50 (light-emitting row) farthest from the center line LC in the sub-scanning direction of the rod lens array 23 as the rotation speed of the photosensitive drum 1 becomes lower. The case is considered where the image forming apparatus has a first low-speed mode, a second low-speed mode, a third low-speed mode, and a fourth low-speed mode, wherein the first low speed mode is the same as the low-speed mode of the above embodiment, the second low-speed mode is lower than the first low-speed mode, the third low-speed mode is lower than the second low-speed mode, and the fourth low-speed mode is lower than the third low-speed mode, so that the number of the light-emitting portions 50 (light-emitting rows) used for multiple exposures is reduced as the rotation speed of the photosensitive drum 1 becomes lower. For example, three light-emitting portions 50 are used in the second low-speed mode, two light-emitting portions 50 are used in the third low-speed mode, and one light-emitting portion 50 is used in the fourth low-speed mode. In this case, it is preferable to adopt the configuration in which the light-emitting portions are sequentially turned off in the order shown in FIG. 19A to FIG. 19E, starting from the light-emitting portion 50*e* (light emitting row) farthest from the center line LC in the sub-scanning direction of the rod lens array 23 as the rotation speed of the photosensitive drum 1 becomes lower.

Figures 20A, 20B, 20C, 20D, 20E:
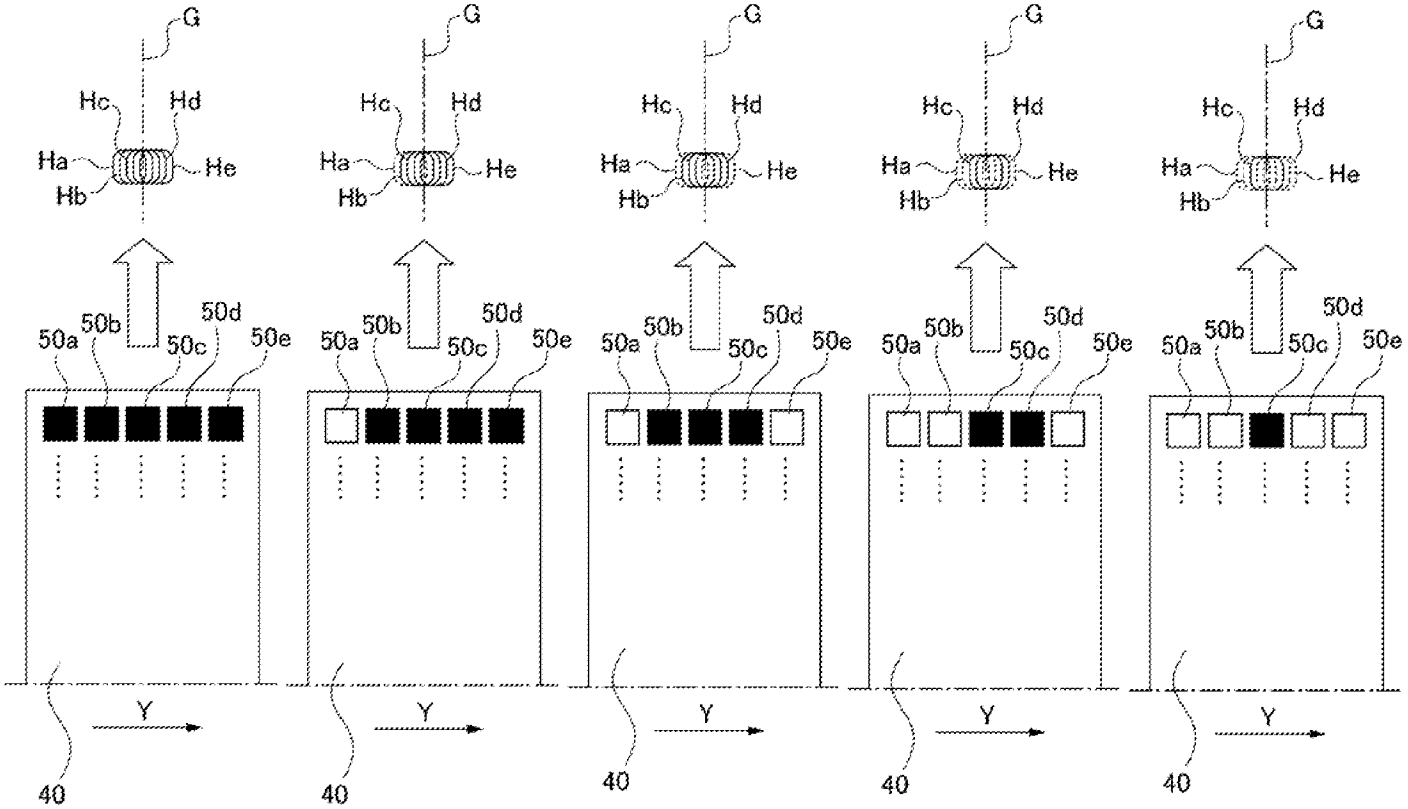
FIGS. 20A, 20B, 20C, 20D, and 20E are schematic diagrams of the light-emitting portions and spots on the photosensitive drum of light irradiated with light emitted from the light-emitting portions.

When performing the low-speed mode, the light emitting portions may be turned off not only the light emitting portion 50 farthest from the center line LC in the sub-scanning direction of the rod lens array 23, but also another one out of the light emitting portions 50. For example, when performing the low-speed mode, one of the light-emitting portions 50 located at the ends of the sub-scanning direction may be configured to be turned off. In other words, as shown in FIG. 20A and FIG. 20B, multiple exposures may be performed using five light-emitting portions 50*a* to 50*e* in the normal mode, and multiple exposures are performed using light-emitting portions 50*b* to 50*e* by turning off the light-emitting portion 50*a* in the low-speed mode.

In the configuration of the image forming apparatus A where the rotation speed of the photosensitive drum 1 can be changed in a stepwise fashion according to the basis weight of the sheet S and the number of pixels in the sub-scanning direction by the CPU 73, the light-emitting portions 50 are controlled as follows. That is, out of the light-emitting portions 50*a* to 50*e* used for multiple exposures in the normal mode, the light-emitting portions are sequentially turned off from the light-emitting portions 50 far from the light-emitting portion 50*c* at the center of the sub-scanning direction. In other words, as the rotation speed of the photosensitive drum 1 becomes lower, the light-emitting portions may be turned off in the order shown in FIG. 20A to FIG. 20E, starting with the light-emitting portion 50*a*, which is farthest from the light-emitting port 50*c*.

By turning off the light-emitting portions 50 in this way, the following effect can be obtained. When the light spots irradiated with light emitted from the light-emitting portions 50 are combined on the photosensitive drum 1 with multiple exposure, the maximum amount of light is obtained at the center position of the combined light spots in the sub-scanning direction and the maximum amount of toner is adhered there during development. In this case, if the maximum position of the toner shifts for each of the dots for making up an image, the intervals between adjacent dots become uneven and the image quality deteriorates. In contrast, by turning off the light-emitting portions 50*a* to 50*e* in the order shown in FIG. 20A to FIG. 20E, the shift of the center position Gin the sub-scanning direction of the combined light spots becomes smaller. This suppresses the shift of the position of the maximum toner for each dot and the unevenness of the intervals between dots, thereby suppressing deterioration in image quality.

<Arrangement of Light-Emitting Portions in Other Embodiments>

In the above description, the light-emitting portions 50 for forming a single pixel are arranged in a single line in the direction of rotation of the photosensitive drum 1. As a result, when the light-emitting portions 50 are viewed along the direction of rotation of the photosensitive drum 1, these light-emitting portions 50 overlap with each other.

In the embodiment described next, the light-emitting portions 50 lined up in the direction of rotation are slightly offset for each row. In other words, when the light-emitting portions 50 are viewed along the direction of rotation of the photosensitive drum 1, even if the light-emitting portions 50 are located in different rows for multiple exposures of the same single pixel, they only partially overlap with each other.

Figure 21A:
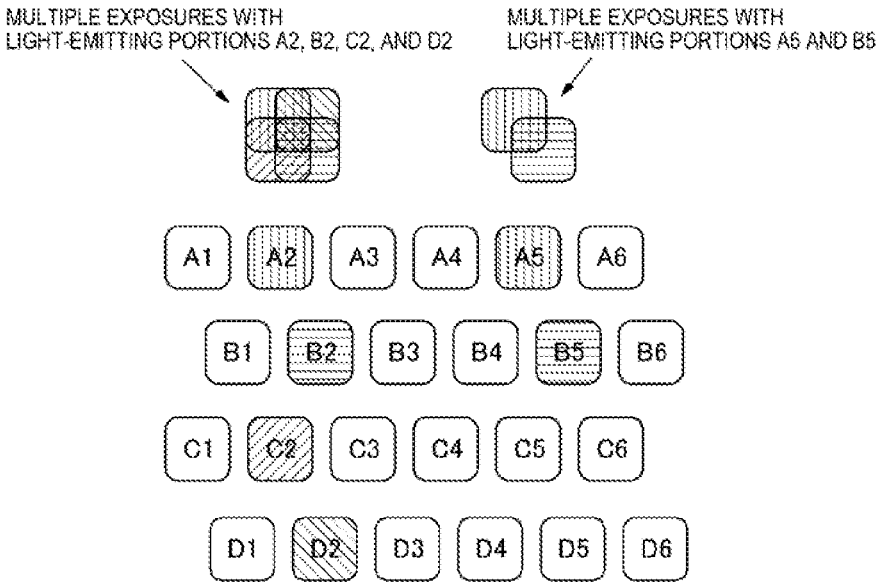
FIGS. 21A and 21B are schematic diagrams showing the arrangements of the light-emitting portions in other embodiments.

FIG. 21A illustrates the light-emitting portions 50 that emits light to multiply expose the region corresponding to one pixel on the photosensitive drum 1. As shown in FIG. 21A, the region corresponding to one pixel on the photosensitive drum 1 is multiply exposed by the light-emitting portions A2 in the row A, B2 in the row B, C2 in the row C, and D2 in the row D. As understood from FIG. 21A, when the light emitting portion A2 is viewed along the direction of rotation of the photosensitive drum 1, for example, the light-emitting portion A2 only partially overlaps with the light-emitting portion B2. The overlapping area corresponds to the region to be multiply exposed. The area which is multiply exposed by the light-emitting portions 50 of all the light emitting rows when the light-emitting portions 50 of the light emitting rows are arranged such that the light-emitting portions 50 only partially overlap with each other in the rotation direction is smaller than that when the light-emitting portions 50 are arranged such that all of them completely overlap with each other in the rotation direction. This configuration can increase the apparent resolution.

As shown in FIG. 21A, in the normal mode (first mode), the region corresponding to one pixel on the photosensitive drum 1 is multiply exposed by the light-emitting portion A2 in the row A, the light-emitting portion B2 in the row B, the light-emitting portion C2 in the row C, and the light-emitting portion D2 in the row D. On the other hand, in the low-speed mode (the second mode), the region corresponding to one pixel on the photosensitive drum 1 is multiply exposed by two light emitting portions, i.e., the light-emitting portion A2 in the row A and the light emitting portion D2 in the row D. Namely, by changing the number of light-emitting rows to multiply expose the region corresponding to one pixel on the photosensitive drum 1 according to respective modes, the total amount of light with which the region to be multiply exposed is irradiated can be changed. Specifically, in the example shown in FIG. 21A, multiple exposures in the low-speed mode are performed by the light-emitting portion A2 in the row A and the light-emitting portion D2 in the row D, whereas multiple exposures in the normal mode are performed by the light-emitting portion A2 in the row A, the light-emitting portion B2 in the row B, the light-emitting portion C2 in the row C, and the light-emitting portion D2 in the row D. As a result, the total light amount in the normal mode is about twice the total light amount in the low-speed mode. When the rotation speed of the photosensitive drum 1 in the low-speed mode is halved compared to the rotation speed of the photosensitive drum 1 in the normal mode, the total light amount is halved in the low-speed mode. As a result, it is possible to reduce the risk of image density becoming darker when images are formed in the low-speed mode than when images are formed in the normal mode.

Figure 21B:
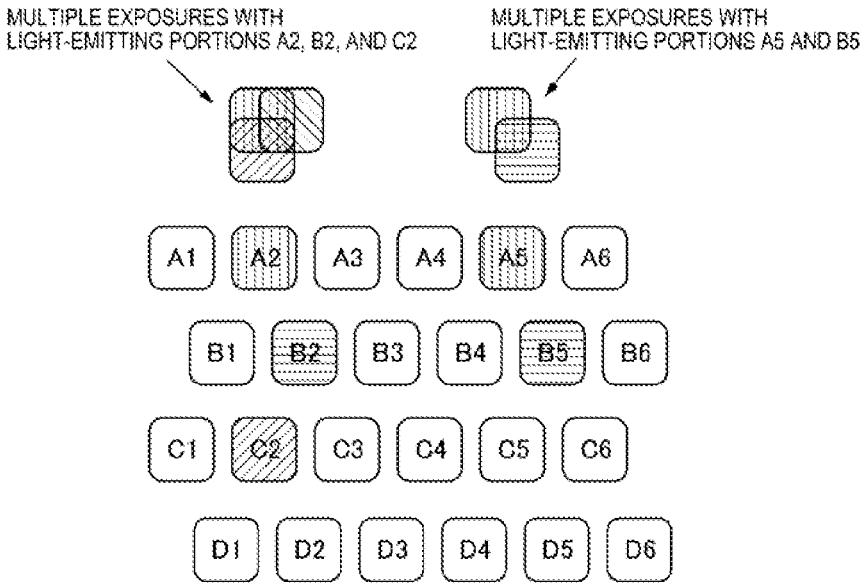

FIG. 21B illustrates an example of changing the number of the light-emitting portions for multiple exposures in the normal mode. In FIG. 21B, the light-emitting portion A2 in the row A, the light-emitting portion B2 in the row B, and the light-emitting portion C2 in the row C are lit for multiple exposures on the photosensitive drum 1. In this case, the total light amount is ¾ compared to the case where four light-emitting rows from A to D (light-emitting portions A2, B2, C2, and D2) are lit as shown in FIG. 21A. In this way, by adjusting the number of light-emitting rows for multiple exposures, the total light amount for multiply exposing the region corresponding to one pixel on the photosensitive drum is adjusted, multi-gradation can be expressed. Even in this case, the CPU 73 controls the light-emitting portions 50 of the respective rows such that the number of light-emitting rows for multiply exposing the region corresponding to one pixel on the photosensitive drum 1 in the normal mode is greater than that in the low-speed mode.

As described above, even if the rotation speed of the photosensitive drum 1 is different in operational modes, the total light amount for exposing the region corresponding to one pixel on the photosensitive drum 1 to be multiply exposed is adjusted by changing the number of light-emitting rows for multiple exposure according to an operational mode. This suppresses a change in the image density depending on an operational mode even for the same image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-120310, filed Jul. 14, 2020, which is hereby incorporated by reference herein in its entirety.

What is claimed is:

1. An image forming apparatus including a rotating photosensitive drum, the image forming apparatus being capable of operating in a first mode in which the photosensitive drum is rotated at a first rotating speed and a second mode in which the photosensitive drum is rotated at a second rotating speed lower than the first rotating speed, the image forming apparatus comprising:

an exposure head including a plurality of light-emitting rows, each of which includes light-emitting portions configured to emit light for exposing the photosensitive drum, the light-emitting portions of each of the plurality of the light-emitting rows being arranged along a rotational axis direction of the photosensitive drum, the plurality of the light-emitting rows being arranged in a direction crossing the rotational axis direction, the exposure head being configured to multiply expose a region which corresponds to one pixel on the photosensitive drum with light-emitting portions included in at least two of the plurality of light-emitting rows out of the plurality of light-emitting rows; and a control unit configured to control the exposure head such that the number of the light-emitting rows to be used for multiply exposing the region which corresponds to one pixel in the second mode is less than that in the first mode.

2. The image forming apparatus according to claim 1, wherein the control unit controls the exposure head such that a sum of light amounts of the light-emitting portions that multiply expose the region which corresponds to one pixel in the second mode is less than that in the first mode.

3. The image forming apparatus according to claim 1, wherein the exposure head comprises:

a circuit board;

array chips provided on the circuit board such that the array chips are arranged in the rotational axis direction in a staggered manner, the light-emitting rows being arranged in the direction crossing the rotational axis direction in each array chip of the array chips; and a lens array configured to condense light emitted from the light-emitting portions onto the photosensitive drum, the lens array being arranged such that the lens array overlaps with a center line of the array chips in directions of optical axes of the lens array, wherein the control unit controls the exposure head such that a light-emitting portion of a light-emitting row closest to the optical axes out of the plurality of light-emitting rows emits light when the region which corresponds to one pixel is multiply exposed in both the first mode and the second mode.

4. The image forming apparatus according to claim 1, wherein the exposure head comprises:

a circuit board;

array chips provided on the circuit board such that the array chips are arranged in the rotational axis direction in a staggered manner, the light-emitting rows being arranged in the direction crossing the rotational axis direction in each array chip of the array chips; and a lens array configured to condense light emitted from the light-emitting portions onto the photosensitive drum, the lens array being arranged such that the lens array overlaps with a center line of the array chips in a direction of optical axes of the lens array, wherein the control unit controls the exposure head such that a light-emitting portion of a light-emitting row farthest from the optical axes out of the plurality of light-emitting rows does not emit light when the region which corresponds to one pixel is multiply exposed in the second mode.

5. The image forming apparatus according to claim 1, further comprising:

a developing unit configured to develop with toner an electrostatic latent image formed on the photosensitive drum by the exposure head;

a transfer unit configured to transfer a toner image formed on the photosensitive drum to a sheet; and a fixing unit configured to fix the toner image to the sheet, wherein the control unit controls a conveying speed of a sheet passing through the fixing unit based on information about a basis weight of the sheet on which an image is formed such that when the conveying speed is a first conveying speed, a rotational speed of the photosensitive drum is the first rotational speed and when the conveying speed is a second conveying speed lower than the first conveying speed, a rotational speed of the photosensitive drum is the second rotational speed.

6. The image forming apparatus according to claim 1, wherein the control unit controls the exposure head such that a light amount of each of the light-emitting portions to be used for multiply exposing the region which corresponds to one pixel is the same.

7. The image forming apparatus according to claim 1, wherein the light-emitting portions comprise:

a first electrode layer including electrodes arranged on a substrate in a two-dimensional array in the rotational axis direction and the direction crossing the rotational axis direction, the electrodes being separated;

a light-emitting layer stacked on the first electrode layer, the light-emitting layer emitting light when a voltage is applied thereto; and a second electrode layer arranged on an opposite side of the light-emitting layer to a side on which the first electrode layer is provided, the second electrode layer being transmissible with light.

8. The image forming apparatus according to claim 7, wherein the light-emitting layer comprises an organic EL film.

* * * * *